US011480005B2

(12) United States Patent
Aragai et al.

(10) Patent No.: US 11,480,005 B2
(45) Date of Patent: Oct. 25, 2022

(54) OPENING/CLOSING BODY CONTROL DEVICE, OPENING/CLOSING BODY CONTROL SYSTEM, POWER WINDOW DEVICE, AND POWER WINDOW SYSTEM

(71) Applicants: Takashi Aragai, Aichi (JP); Makoto Adachi, Aichi (JP); Tomohiro Murase, Gifu (JP)

(72) Inventors: Takashi Aragai, Aichi (JP); Makoto Adachi, Aichi (JP); Tomohiro Murase, Gifu (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 571 days.

(21) Appl. No.: 16/659,212

(22) Filed: Oct. 21, 2019

(65) Prior Publication Data

US 2020/0190888 A1 Jun. 18, 2020

(30) Foreign Application Priority Data

Dec. 13, 2018 (JP) ..... JP2018-233421

(51) Int. Cl.
*E05F 15/695* (2015.01)
*E05F 15/40* (2015.01)
*E05F 15/70* (2015.01)

(52) U.S. Cl.
CPC ..... *E05F 15/695* (2015.01); *E05F 15/40* (2015.01); *E05F 15/70* (2015.01); *E05Y 2400/54* (2013.01); *E05Y 2900/55* (2013.01)

(58) Field of Classification Search
CPC ..... E05F 15/695; E05F 15/40; E05F 15/70; E05F 2400/54; E05F 2900/55
USPC ..... 701/49
See application file for complete search history.

(56) References Cited

U.S. PATENT DOCUMENTS

2003/0052636 A1 3/2003 Okada et al.
2014/0207343 A1 7/2014 Kigoshi et al.

FOREIGN PATENT DOCUMENTS

JP 2007-327240 A 12/2007
JP 4732628 B2 7/2011
JP 2014-122502 A 7/2014
JP 2014-139382 A 7/2014

*Primary Examiner* — Mahmoud Gimie
(74) *Attorney, Agent, or Firm* — Osha Bergman Watanabe & Burton LLP

(57) ABSTRACT

An opening/closing body control device continues an as-needed operation where the opening/closing body is controlled in response to the operation instruction signal even when an abnormality in an opening/closing position of the opening/closing body is detected, continues opening and closing the opening/closing body until it is determined that the abnormal state in the opening/closing instruction signal is confirmed even when an abnormality in the opening/closing instruction signal is detected during the as-needed opening/closing operation, and stops opening and closing the opening/closing body the abnormal state in the opening/closing instruction signal is confirmed. The confirmation time at the presence of the opening/closing position abnormality is shorter than that at the absence of opening/closing position abnormality.

9 Claims, 10 Drawing Sheets

OPENING/CLOSING BODY CONTROL DEVICE, OPENING/CLOSING BODY CONTROL SYSTEM, POWER WINDOW DEVICE, AND POWER WINDOW SYSTEM

CROSS-REFERENCES TO RELATED APPLICATIONS

This application is based upon and claims the benefit of priority from Japanese Patent Application No. 2018-233421, filed on Dec. 13, 2018; the entire contents of which are incorporated herein by reference.

FIELD

One or more embodiments of the present invention relate to an opening/closing body control device and an opening/closing body control system for controlling an opening/closing operation of an opening/closing body such as a window of a vehicle.

BACKGROUND

As an opening/closing body control device and an opening/closing body control system for controlling an opening/closing operation of an opening/closing body, for example, there is a power window device or a power window system mounted on a vehicle as disclosed in JP-A-2007-327240. There are also a sunroof device or a sunroof system for vehicles as disclosed in JP-B-4732628, for example.

For example, in the power window device, based on the operation of a manipulation switch, the drive of a motor is controlled, and a window glass provided on a vehicle door is moved to open and close the window. Such power window devices and manipulation switches are installed on doors such as a driver seat, a passenger seat, and left/right rear portion seats of a vehicle to open and close the windows on the corresponding seats.

Further, the above manipulation switch may be installed in a portable device such as a remote control unit (for example, JP-A-2014-139382). In this case, for example, when the manipulation switch is manipulated, a signal corresponding to the manipulation state is transmitted from the portable device to an electronic control device mounted on a vehicle. The electronic control device transmits an operation instruction signal for instructing the operation of the window to the power window device based on the signal received from the portable device. The power window device opens and closes the window by controlling the drive of the motor based on the operation instruction signal received from the electronic control device.

The power window device detects a pulse synchronized with the rotation of a motor while the window is opened or closed, and detects an opening/closing position of the window (an upper end position of the window glass) based on the pulse. Specifically, for example, a pulse synchronized with the rotation of the motor is detected based on an output from an encoder installed in the vicinity of the motor, a ripple included in a current flowing through the motor, or the like. An opening/closing position of the window is detected based on a count value obtained by counting the number of pulses.

The power window device controls the drive of the motor based on the detected opening/closing position of the window, and controls the operation and operation speed of the window glass. When the window glass becomes in a fully open state or a fully closed state, the drive of the motor is stopped and the opening and closing of the window is stopped. The opening/closing body control device other than the power window device similarly detects the position of the opening/closing body and controls the opening/closing operation of the opening/closing body based on the detection result.

As the operation of the power window device, there are an auto mode in which the window is automatically opened or closed to a fully open state or a fully closed state (full opening/closing operation), and a manual mode in which the window is opened or closed only while the manipulation switch is manipulated (as-needed opening/closing operation) based on the temporary manipulation of the manipulation switch.

The manipulation switch for the power window device can be switched among five manipulation states of manual closing, auto closing, manual opening, auto opening, and neutral (stop), and can be switched among three manipulation states of manual closing, manual opening, and neutral. When instructing opening and closing of the window in a manual mode, the manipulation switch is manipulated to the manual closing state or the manual opening state. When instructing opening and closing of the window in an auto mode, the manipulation switch is manipulated to the auto closing state or the auto opening state.

The manipulation switch that can be switched to the above five manipulation states is installed, for example, on a door of a main seat such as a driver seat of a vehicle, and is manipulated to open and close the window on the seat. The manipulation switches that can be switched to the above three manipulation states are installed, for example, on doors of sub seats such as a passenger seat or left/right rear portion seats of a vehicle, and are manipulated to open and close the windows on these sub seats.

For example, there is a vehicle in which a manipulation switch for a driver seat window as well as manipulation switches for windows of other seats are installed on the door of the driver seat. In this vehicle, the power window device for the driver seat and the power window devices for the other seats are connected to a communication bus built in the vehicle. When a manipulation switch for the window on the other seat installed in the driver seat is manipulated, an operation instruction signal for the window on the other seat corresponding to the manipulation state is transmitted from the power window device for the driver seat to the power window device for the other seat. Based on the operation instruction signal received from the power window device for the driver seat, the power window device for the other seat controls the drive of the corresponding motor to open and close the corresponding window on the other seat. In other words, the power window device for the driver seat and the power window devices for the other seats communicate with each other to constitute a power window system that opens and closes the window on each seat of the vehicle (JP-A-2014-122502).

On the other hand, there is a power window device have a function of detecting whether a foreign object such as an object or a human body is pinched in a gap between a window glass and a window frame while the window is opened or closed (a pinching detection function). Specifically, for example, the power window device detects a load applied to the motor while the window is opened or closed, and determines that there is a pinch when the amount of load is equal to or greater than a predetermined value. Thereafter, the power window device stops the motor to stop opening and closing of the window glass and reversely drives the motor to operate the window glass in the opposite direction so that damage to objects and human bodies is prevented and safety is ensured. The pinching of foreign objects in the window occurs not only when closing the window but also when opening the window.

SUMMARY

As described above, an opening/closing body control device detects an opening/closing position of an opening/closing body based on a pulse synchronized with the rotation of a motor, and controls the opening/closing operation of the opening/closing body based on the opening/closing position during the opening and closing of the opening/closing body. However, due to a disturbance or a failure of a component for detecting the opening/closing position, an abnormality, in which the opening/closing position of the opening/closing body detected on the basis of the pulse deviates from the actual opening/closing position of the opening/closing body, may occur by false-detecting noise as a pulse, or an abnormality, in which the opening/closing position of the opening/closing body cannot be detected, may occur. When such an abnormality occurs in the opening/closing position, the opening/closing body cannot be opened or closed to the fully open state or the fully closed state, which may impair convenience.

Only while receiving an opening/closing instruction signal for instructing opening and closing of the opening/closing body from the outside (other electronic control devices or opening/closing body control devices), during the as-needed opening/closing operation (manual mode) to open and close the opening/closing body by driving the corresponding motor, in the opening/closing body control device, an abnormality such as interruption of the opening/closing instruction signal due to a disturbance, a communication wiring or a transmission device failure, or disconnection of the communication bus may occur, or an abnormality such as the opening/closing instruction signal being buried in noise and being unable to be received normally may occur. When such an abnormality occurs in the opening/closing instruction signal, the corresponding motor is immediately stopped, and the opening/closing operation of the corresponding opening/closing body is also stopped. In this case, when a user continues the manual opening/closing manipulation of the manipulation switch, since the opening/closing operation of the opening/closing body is stopped unintentionally, the convenience is lowered. In particular, when an abnormality in the opening/closing instruction signal is instantaneous, the opening/closing operation of the opening/closing body is not performed smoothly, and this gives the user a sense of incongruity.

On the other hand, when an abnormality occurs in the opening/closing instruction signal, the opening/closing body control device refers to an operation log immediately before recorded in the memory, for example, and continues the as-needed opening/closing operation. In this case, when there is a risk of a foreign object being pinched in the opening/closing body, the dangerous state continues or the degree of danger increases. In particular, as described above, when an abnormality occurs in the opening/closing position detected by the opening/closing body control device, controls, such as stop or reversely drive a motor for releasing the danger, cannot be performed normally, and the dangerous state continues or the amount of danger rises.

An object of one or more embodiments of the invention is to provide a device and a system that can ensure convenience and safety even if an abnormality occurs in an opening/closing position of an opening/closing body or an opening/closing instruction signal during an as-needed opening/closing operation of the opening/closing body based on the opening/closing instruction signal.

An opening/closing body control device according to one or more embodiments of the invention including: a communication unit that receives an operation instruction signal instructing an operation of an opening/closing body; a control unit that controls a drive of a motor that operates the opening/closing body based on the operation instruction signal received by the communication unit; a pulse detection unit that detects a pulse synchronized with a rotation of the motor; and a position detection unit that detects an opening/closing position of the opening/closing body based on the pulse detected by the pulse detection unit, in which the control unit opens and closes the opening/closing body by driving the motor based on the opening/closing position detected by the position detection unit. In this configuration, the device further including: an operation record unit that records content of the operation when the control unit controls the drive of the motor and operates the opening/closing body based on the operation instruction signal; a position abnormality determination unit that determines a presence/absence of an abnormality in the opening/closing position detected by the position detecting unit; and a signal abnormality determination unit that determines a presence/absence of an abnormality in an opening/closing instruction signal during an as-needed opening/closing operation where the control unit drives the motor and opens and closes the opening/closing body while receiving the opening/closing instruction signal for instructing opening and closing of the opening/closing body as the operation instruction signal by the communication unit. Further, the signal abnormality determination unit measures a duration of an abnormality when it is determined that there is the abnormality in the opening/closing instruction signal, and further determines that an abnormal state of the opening/closing instruction signal is confirmed when the duration is equal to or longer than a predetermined confirmation time. The control unit executes the as-needed opening/closing operation based on the opening/closing instruction signal received by the communication unit, even when the position abnormality determination unit determines that there is an abnormality in the opening/closing position. Further, the control unit continues driving the motor and continues opening and closing the opening/closing body based on the recorded content stored in the operation record until it is determined that the abnormal state in the opening/closing instruction signal is confirmed even when the signal abnormality determination unit determines that there is an abnormality in the opening/closing instruction signal during the as-needed opening/closing operation, and stops the motor and stops opening and closing the opening/closing body when the signal abnormality determination unit determines that the abnormal state in the opening/closing instruction signal is confirmed. In addition, the confirmation time when the position abnormality determination unit determines that there is an abnormality in the opening/closing position is shorter than the confirmation time when it is not determined that there is an abnormality in the opening/closing position.

An opening/closing body control system according to one or more embodiments of the invention including: the opening/closing body control device; and an electronic control device that transmits an operation instruction signal for instructing an operation of an opening/closing body to the opening/closing body control device.

A power window device according to one or more embodiments of the invention includes the opening/closing body control device described above, and opens and closes a vehicle window that is an opening/closing body.

A power window system according to one or more embodiments of the invention including a plurality of power window devices for opening and closing a vehicle window, in which among the plurality of power window devices, at least one power window device includes the opening/closing body control device described above, and another power window device transmits an operation instruction signal instructing an operation of the window to the at least one power window device according to a manipulation state of a manipulation switch manipulated to instruct opening and closing of the window corresponding to the at least one power window device. Further, based on the operation instruction signal received from the another power window device, the at least one power window device controls the drive of the corresponding motor, and opens and closes the corresponding window.

In the opening/closing body control device according to one or more embodiments of the invention, even when an abnormality occurs in the opening/closing position of the opening/closing body detected by the position detection unit, since the as-needed opening/closing operation of the opening/closing body is executed based on the opening/closing instruction signal received by the communication unit, user convenience can be ensured. Further, even when an abnormality occurs in the opening/closing instruction signal during the as-needed opening/closing operation of the opening/closing body, the abnormal state of the opening/closing instruction signal is not confirmed unless the duration of the abnormality is equal to or longer than the confirmation time. Since the drive of the motor is continued and the opening and closing of the opening/closing body is continued until the abnormal state in the opening/closing instruction signal is confirmed, if the abnormality in the opening/closing instruction signal is temporary or instantaneous, then the opening/closing body is continuously opened or closed without a sense of incongruity, and user convenience can be ensured. Further, when the duration of the abnormality in the opening/closing instruction signal is equal to or longer than the confirmation time during the as-needed opening/closing operation of the opening/closing body, the abnormal state of the opening/closing instruction signal is confirmed, the motor is stopped, and the opening and closing of the opening/closing body is stopped. Therefore, when an abnormality in the opening/closing instruction signal continues for a long time, the opening/closing body does not continue to open and close involuntarily, so that even when there is a danger of a foreign object being pinched in the opening/closing body, the danger can be suppressed or avoided, and safety can be ensured.

In addition, when there is no abnormality in the opening/closing position detected by the position detection unit, the duration of the abnormality in the opening/closing instruction signal is compared with the confirmation time which is set long, the time until the abnormal state in opening/closing instruction signal is confirmed becomes longer. The user convenience can be further ensured by continuing to open and close the opening/closing body for a while until the abnormal state in the opening/closing instruction signal is confirmed. After the abnormality in the opening/closing instruction signal is confirmed, based on the opening/closing position of the normal opening/closing body detected by the position detection unit, the motor can be surely stopped and the opening and closing of the opening/closing body can be stopped, thereby even if there is a danger of a foreign object being pinched in the opening/closing body, the danger can be suppressed or avoided, and safety can be further improved. Further, when there is an abnormality in the opening/closing position detected by the position detection unit, since the duration of the abnormality in the opening/closing instruction signal is compared with the confirmation time which is set short, the abnormal state in the opening/closing instruction signal is confirmed in a short time after the abnormality occurs in the opening/closing instruction signal, thereby the motor can be stopped, and the opening and closing of the opening/closing body can be stopped immediately.

Therefore, based on the opening/closing position abnormality detected by the position detection unit, the time to continue driving the motor, and the time to continue opening and closing the opening/closing body are shortened, thereby even if there is a danger of a foreign object being pinched in the opening/closing body, the danger can be suppressed or avoided, and safety can be further improved.

The opening/closing body control device according to one or more embodiments of the invention, further including: a load detection unit that detects a load on the motor; and a pinch determination unit that determines a presence/absence of a pinch of a foreign object by the opening/closing body based on the load detected by the load detection unit, in which the control unit temporarily may stop the motor and then reversely drive the motor, and operate the opening/closing body in an opposite direction, when the signal abnormality determination unit determines that the abnormal state of the opening/closing instruction signal is confirmed and the pinch determination unit determines that the pinch is present during the as-needed opening/closing operation.

The opening/closing body control device according to one or more embodiments of the invention, the control unit may temporarily stop the motor and then reversely drive the motor, and operate the opening/closing body in the opposite direction when the pinch determination unit determines that the pinch is present without determining that the abnormal state of the opening/closing instruction signal is confirmed by the signal abnormality determination unit during the as-needed opening/closing operation in a case where the position abnormality determination unit does not determine that there is an abnormality in the opening/closing position. Further, the control unit may continue driving the motor and continue opening and closing the opening/closing body even when the pinch determination unit determines that the pinch is present without determining that the abnormal state of the opening/closing instruction signal is confirmed by the signal abnormality determination unit during the as-needed opening/closing operation in a case where the position abnormality determination unit determines that there is an abnormality in the opening/closing position.

The opening/closing body control device according to one or more embodiments of the invention, the position detection unit may detect an opening/closing position of the opening/closing body based on a count value obtained by counting the number of pulses, and even when the count value of the pulses counted by the position detection unit is equal to or greater than a predetermined value corresponding to a fully open state or a fully closed state that is an end of an opening/closing operation of the opening/closing body, the position abnormality determination unit may determine that there is an abnormality in the opening/closing position when the pulse is continuously detected by the pulse detection unit.

The opening/closing body control device according to one or more embodiments of the invention, the signal abnormality determination unit may determine that there is an abnormality in the opening/closing instruction signal when the abnormality occurs in which reception of the opening/closing instruction signal by the communication unit is interrupted.

The opening/closing body control system according to one or more embodiments of the invention, at least one opening/closing body control device may be provided, the electronic control device may be include an opening/closing body control device different from the opening/closing body control device, each opening/closing body control device may control a drive of a motor corresponding to each opening/closing body control device, and operate the corresponding opening/closing body, the electronic control device may transmit the operation instruction signal according to a manipulation state of a manipulation unit manipulated to instruct the operation of the opening/closing body corresponding to the at least one opening/closing body control device to the at least one opening/closing body control device, and based on the operation instruction signal received from the electronic control device, the at least one opening/closing body control device may control the drive of the motor corresponding to the opening/closing body control device and operate the corresponding opening/closing body.

According to one or more embodiments of the invention, it is possible to provide a device and a system for an opening/closing body control that can ensure convenience and safety even if an abnormality occurs in an opening/closing position of an opening/closing body or an opening/closing instruction signal during an as-needed opening/closing operation of the opening/closing body based on the opening/closing instruction signal.

DETAILED DESCRIPTION

Figure 1:
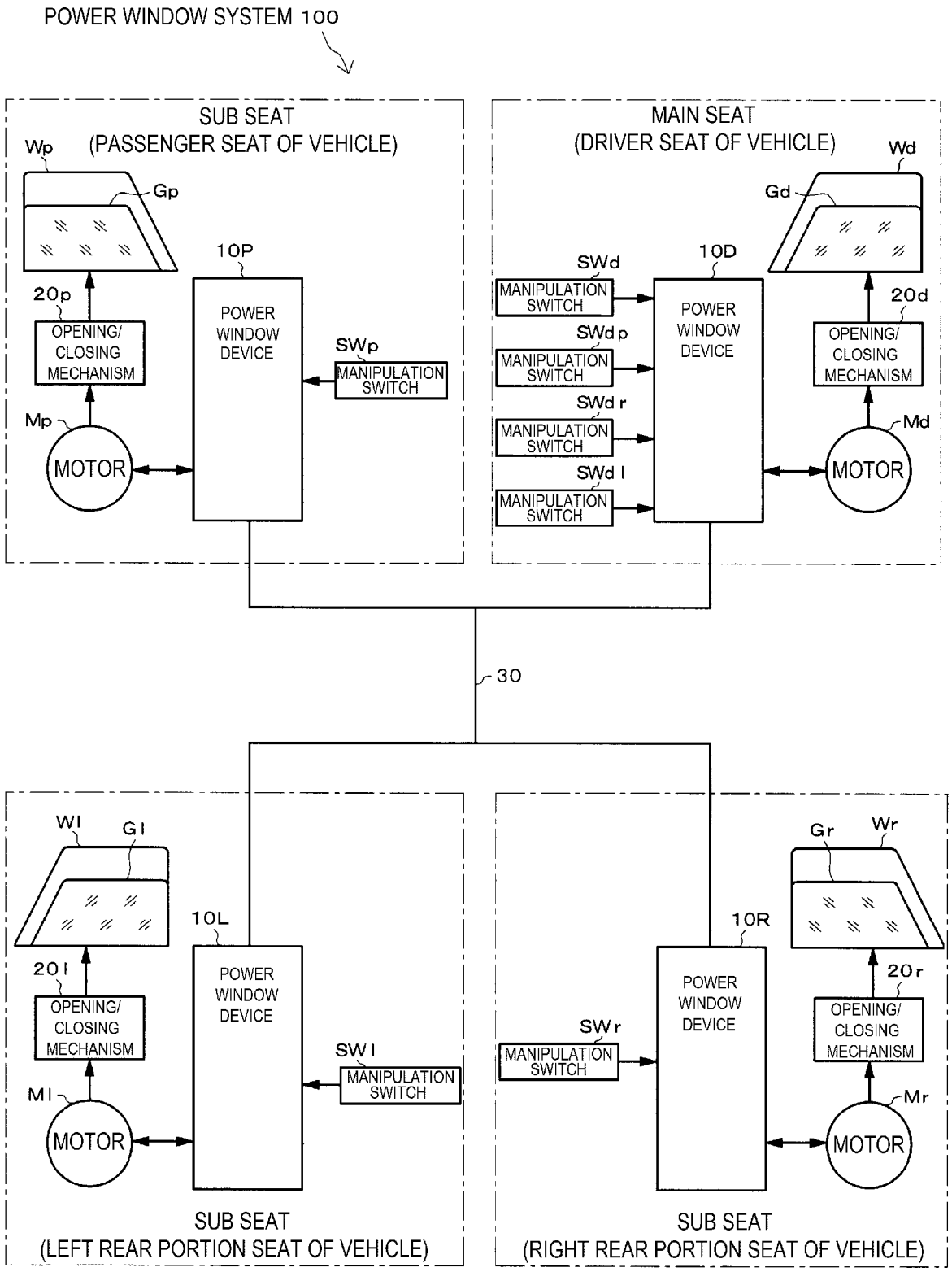
FIG. 1 is a configuration diagram of a power window system according to an embodiment of the present invention.

In embodiments of the invention, numerous specific details are set forth in order to provide a thorough understanding of the invention. However, it will be apparent to one of ordinary skill in the art that the invention may be practiced without these specific details. In other instances, well-known features have not been described in detail to avoid obscuring the invention.

Hereinafter, an embodiment of the present invention will be described with reference to the drawings. In each drawing, the same or corresponding parts are denoted by the same reference numerals.

FIG. 1 is a configuration diagram of a power window system 100 according to an embodiment of the present invention. The power window system 100 is mounted on a vehicle consisting of an automatic four-wheeled vehicle. The power window system 100 includes windows Wd, Wp, Wr, and Wl, opening/closing mechanisms 20*d*, 20*p*, 20*r*, and 20*l*, motors Md, Mp, Mr, and Ml, manipulation switches SWd, SWdp, SWdr, SWdl, SWp, SWr, and SWl, and power window devices 10D, 10P, 10R, and 10L.

Among them, the window Wd, the opening/closing mechanism 20*d*, the motor Md, the manipulation switches SWd, SWdp, SWdr, and SWdl, and the power window device 10D are provided on a door on a driver seat of the vehicle. The window Wp, the opening/closing mechanism 20*p*, the motor Mp, the manipulation switch SWp, and the power window device 10P are provided on a door on the passenger seat of the vehicle. The window Wr, the opening/closing mechanism 20*r*, the motor Mr, the manipulation switch SWr, and the power window device 10R are provided on a door on a right rear portion seat of the vehicle. The window Wl, the opening/closing mechanism 20*l*, the motor Ml, the manipulation switch SWl, and the power window device 10L are provided on a door on a left rear portion seat of the vehicle. In this example, the driver seat is referred to as a "main seat" and the other seats are collectively referred to as a "sub seat".

The power window devices 10D, 10P, 10R, and 10L are configured with an electronic control device (ECU: electronic control unit). The power window devices 10D, 10P, 10R, and 10L controls the drive of the electrically coupled corresponding motors Md, Mp, Mr, and Ml, based on the manipulation of the electrically coupled corresponding manipulation switches SWd, SWdp, SWdr, SWdl, SWp, SWr, and SWl. Then, by the driving force of the motors Md, Mp, Mr, and Ml, the mechanically connected corresponding opening/closing mechanisms 20*d*, 20*p*, 20*r*, and 20*l* are operated, the window glasses Gd, Gp, Gr, and Gl are moved, and the windows Wd, Wp, Wr, and Wl are opened or closed. Further, by stopping the motors Md, Mp, Mr, and Ml, the opening/closing mechanisms 20*d*, 20*p*, 20*r*, and 20*l* are stopped, the window glasses Gd, Gp, Gr, and Gl are stopped, and the opening and closing of the windows Wd, Wp, Wr, and Wl is stopped.

Specifically, the power window device 10D for the main seat raises/lowers the window glass Gd to open and close the window Wd on the main seat and stop the opening/closing by controlling the drive of the motor Md based on the manipulation of the manipulation switch SWd to operate the opening/closing mechanism 20*d*.

The power window devices 10P, 10R, and 10L for the sub seats raise/lower the window glasses Gp, Gr, and Gl to open and close the windows Wp, Wr, and Wl on the sub seats and stop the opening/closing by controlling the drive of the motors Mp, Mr, and Ml and operating the opening/closing mechanisms 20*p*, 20*r*, and 20*l* based on the manipulation of the corresponding manipulation switches SWp, SWr, and SWl, respectively.

The manipulation switch SWdp provided in the main seat is manipulated to instruct the operation (opening/closing or stopping of opening/closing) of the window Wp on the passenger seat. The manipulation switch SWdr is manipulated to instruct the operation of the window Wr on the right rear portion seat. The manipulation switch SWdl is manipulated to instruct the operation of the window Wl on the left rear portion seat.

The power window devices 10D, 10P, 10R, and 10L are electrically coupled to a communication bus 30 built in the vehicle so that signals or information can be communicated with each other. The power window device 10D for the main seat transmits an operation instruction signal for operating the windows Wp, Wr, and Wl on the sub seats to the power window devices 10P, 10R, 10L for the sub seat sides via the communication bus 30 based on the manipulation state of the manipulation switches SWdp, SWdr, and SWdl provided on the main seat. The power window devices 10P, 10R, and 10L for the sub seats control the drive of the motors Mp, Mr, and Ml, based on the operation instruction signal received from the power window device 10D for the main seat, to operate the opening/closing mechanisms 20*p*, 20*r*, and 20*l* and operate the windows Wp, Wr, and Wl.

The power window system 100 is an example of the "opening/closing body control system" according to one or more embodiments of the inventions. The power window devices 10D, 10P, 10R, and 10L are examples of the "opening/closing body control device" according to one or more embodiments of the inventions. The windows Wd, Wp, Wr, and Wl are examples of the "opening/closing body" according to one or more embodiments of the inventions.

The configurations of the windows Wd, Wp, Wr, and Wl, the opening/closing mechanisms 20*d*, 20*p*, 20*r*, and 20*l*, and the motors Md, Mp, Mr, and Ml are the same as known ones, and detailed description thereof is omitted.

Figure 2:
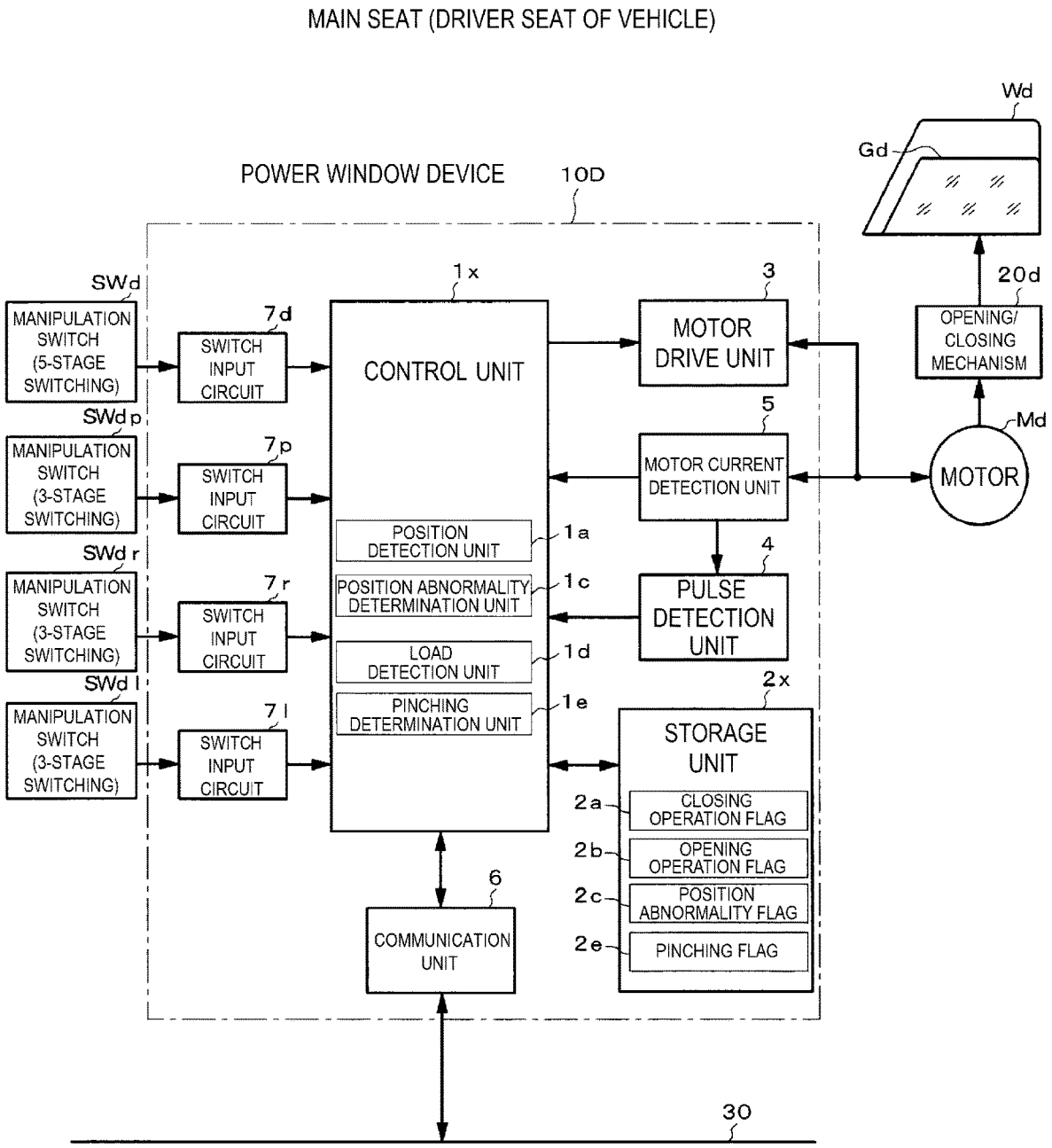
FIG. 2 is an electric block diagram of a power window device for a main seat in FIG. 1.

FIG. 2 is an electric block diagram of the power window device 10D for the main seat. The power window device 10D for the main seat includes a control unit 1*x*, a storage unit 2*x*, a motor drive unit 3, a pulse detection unit 4, a motor current detection unit 5, a communication unit 6, and switch input circuits 7*d*, 7*p*, 7*r*, and 7*l*.

Figure 3:
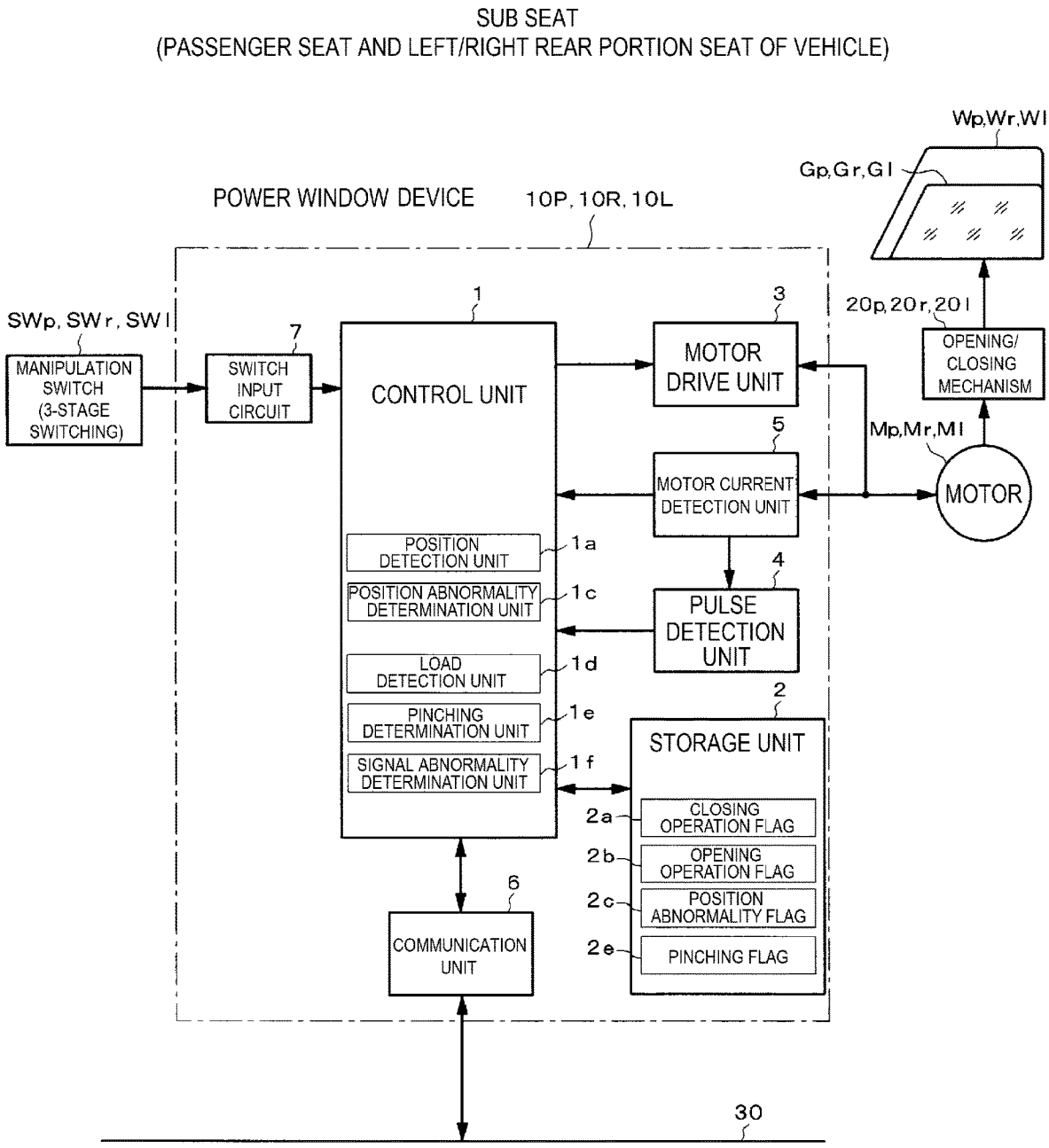
FIG. 3 is an electric block diagram of the power window device for a sub seat in FIG. 1.

FIG. 3 is an electrical block diagram of the power window devices 10P, 10R, and 10L for the sub seats. The power window device 10P, 10R, and 10L for the sub seats include a control unit 1, a storage unit 2, a motor drive unit 3, a pulse detection unit 4, a motor current detection unit 5, a communication unit 6, and switch input circuits 7.

In the power window device 10D for the main seat shown in FIG. 2 and the power window devices 10P, 10R, and 10L for the sub seats shown in FIG. 3, parts having the same name are basically assigned the same reference numerals, and parts having different characteristic functions are given different reference numerals, for convenience of explanation.

In FIGS. 2 and 3, the control units 1*x* and 1 of the power window devices 10D, 10P, 10R, and 10L are constituted by a microcomputer. The control units 1*x* and 1 are provided with a position detection unit 1*a*, a position abnormality determination unit 1*c*, a load detection unit 1*d*, and a pinch determination unit 1*e*. Further, the control unit 1 in FIG. 3 is also provided with a signal abnormality determination unit 1*f*.

The storage units 2*x* and 2 are constituted by a memory. In the storage units 2*x* and 2, information for the control units 1*x* and 1 to control each unit is stored in advance or stored as needed. Further, a closing operation flag 2*a*, an opening operation flag 2*b*, a position abnormality flag 2*c*, and a pinching flag 2*e* are provided in predetermined areas in the storage units 2*x* and 2.

The motor drive unit 3 is configured with a circuit that drives/stops the motors Md, Mp, Mr, and Ml. The motor drive unit 3 supplies current to the motors Md, Mp, Mr, and Ml to drive the motors Md, Mp, Mr, and Ml forward or reverse rotation, or stop supplying current to the Md, Mp, Mr, and Ml to stop the motors Md, Mp, Mr, and Ml. The control units 1*x* and 1 control the drive of the motors Md, Mp, Mr, and Ml by the motor drive unit 3 to operate/stop the opening/closing mechanisms 20*d*, 20*p*, 20*r*, and 20*l*, raise/lower the window glass Gd, Gp, Gr, and Gl, and open and close the windows Wd, Wp, Wr, and Wl.

A motor current detection unit 5 is configured with a circuit that detects a current (motor current) flowing through the motors Md, Mp, Mr, and Ml. The motor current detection unit 5 detects the magnitude of the motor current (motor current value) at a predetermined cycle and outputs the detected magnitude to the control units 1*x* and 1.

The load detection unit 1*d* reads a motor current value detected by the motor current detection unit 5 as needed, and detects the loads on the motors Md, Mp, Mr, and Ml based on a fluctuation state of the motor current value.

The pinch determination unit 1*e* determines the presence/absence of the pinch of a foreign object (human body or object) into the windows Wd, Wp, Wr, and Wl based on the loads on the motors Md, Mp, Mr, and Ml detected by the load detection unit 1*d*. Specifically, the pinch determination unit 1*e* determines that there is a pinch when the amount of load on the motors Md, Mp, Mr, and Ml is equal to or greater than a threshold value. The threshold value for pinch determination is stored in the storage units 2*x* and 2. As described above, when the pinch determination unit 1*e* determines that there is a pinch, the control units 1*x* and 1 turn on the pinching flag 2*e* in the storage units 2*x* and 2. Further, when the pinching state is dissolved, the control units 1*x* and 1 turn off the pinching flag 2*e*.

The pinching of foreign object into the windows Wd, Wp, Wr, and Wl occurs not only when the windows Wd, Wp, Wr, and Wl are closed, but also when the windows Wd, Wp, Wr, and Wl are opened. Specifically, at the time of the closing operation of the windows Wd, Wp, Wr, and Wl, for example, there is a possibility that a foreign object may be pinched between the tips of the window glasses Gd, Gp, Gr, and Gl and the window frames. Further, at the time of the opening operation of the window Wd, Wp, Wr, and Wl, for example, there is a possibility that a foreign object may be pinched between the glass surfaces of the window glasses Gd, Gp, Gr, and Gl and the window frames, or may be pinched in storage portions (inside the door) of the window glasses Gd, Gp, Gr, and Gl.

The pulse detection unit 4 performs processing for converting ripples included in the motor current detected by the motor current detection unit 5 into pulses. That is, the pulse detection unit 4 detects a pulse synchronized with the rotation of the motors Md, Mp, Mr, and Ml based on the ripple included in the motor current.

The position detection unit la detects the opening/closing positions of the windows Wd, Wp, Wr, and Wl based on the pulses detected by the pulse detection unit 4. Specifically, the position detection unit la counts the number of pulses detected by the pulse detection unit 4, and detects the opening/closing positions of the windows Wd, Wp, Wr, and Wl based on the count value. Further, the position detection unit la detects that the windows Wd, Wp, Wr, and Wl are fully open or fully closed based on the count value of the number of pulses, the presence/absence of the pulse detection, the rotation direction of the motors Md, Mp, Mr, and Ml, and the load on the motors Md, Mp, Mr, and Ml detected by the load detection unit 1*d*. The fully open state of the windows Wd, Wp, Wr, and Wl is a state in which the tips (upper ends) of the window glasses Gd, Gp, Gr, and Gl are reached the fully open position. The fully closed state of the windows Wd, Wp, Wr, and Wl is a state in which the tips of the window glasses Gd, Gp, Gr, and Gl are reached the fully closed position.

The control units 1*x* and 1 control the drive of the motors Md, Mp, Mr, and Ml by the motor drive unit 3 based on the opening/closing positions detected by the position detection unit 1*a* to open and close the windows Wd, Wp, Wr, and Wl. Further, the control units 1*x* and 1 detect the rotation speeds of the motors Md, Mp, Mr, and Ml and the opening/closing speeds of the windows Wd, Wp, Wr, and Wl based on the change in the opening/closing position detected by the position detection unit 1*a*. Information relating to the opening/closing positions and the opening/closing speeds of the windows Wd, Wp, Wr, and Wl is recorded in the storage units 2*x* and 2 by the control units 1*x* and 1 as needed.

The position abnormality determination unit 1*c* determines the presence/absence of an abnormality in the opening/closing position of the windows Wd, Wp, Wr, and Wl detected by the position detection unit 1*a*. When the position abnormality determination unit 1*c* determines that there is an abnormality in the opening/closing position, the control units 1*x* and 1 turn on the position abnormality flag 2*c* of the storage units 2*x* and 2. Further, when the abnormal state is dissolved, the control units 1*x* and 1 turn off the position abnormality flag 2*c*.

The communication unit 6 is configured with a circuit for communicating with the other power window devices 10D, 10P, 10*r*, and 10L via the communication bus 30.

The manipulation switch SWd (FIG. 2) provided in the main seat can be switched to five operation states of manual closing, auto closing, manual opening, auto opening, and neutral (stop). The manipulation switch SWd maintains the neutral state when there is no manipulation. The manipulation switch SWd is switched to the auto closing state or the auto opening state in order for the power window device 10D for the main seat to perform the closing operation or the opening operation of the window Wd on the main seat. The manipulation switch SWd is switched to the manual closing state or the manual opening state in order for the power window device 10D to perform the closing operation or the opening operation of the window Wd in a manual mode. Further, the manipulation switch SWd is switched (release manipulation) from the manual opening state or the manual closing state to the neutral state in order to open and close the window Wd in a manual mode by the power window device 10D.

The opening/closing operation in an auto mode is a full opening/closing operation that automatically opens and closes the window to the fully open state or the fully closed state based on a temporary manipulation of the manipulation switch to the auto opening position or the auto closing position. The opening/closing operation in a manual mode is an as-needed opening/closing operation that opens and closes the window only while the manipulation switch is manipulated to the manual opening position or the manual closing position.

The manipulation switches SWdp, SWdr, and SWdl (FIG. 2) provided on the main seat and the manipulation switches SWp, SWr, and SWl (FIG. 3) provided on the sub seat can be switched among three manipulation states of manual closing, manual opening, and neutral. Each manipulation switch SWdp, SWdr, SWdl, SWp, SWr, and SWl maintains a neutral state when there is no manipulation. The manipulation switches SWdp, SWdr, SWdl, SWp, SWr, and SWl are switched to the manual closing state or the manual opening state in order for the power window devices 10P, 10R, and 10L for the sub seats to perform the closing operation or the opening operation of the windows Wp, Wr, and Wl on the sub seats in a manual mode. Further, the manipulation switches SWdp, SWdr, SWdl, SWp, SWr, and SWl are switched from the manual opening state or the manual closing state to the neutral state in order for the power window devices 10P, 10R, and 10L to stop the opening/closing operation of the windows Wp, Wr, and Wl in a manual mode.

When the manipulation switches SWp, SWr, SWl on the sub seat is switched, signals corresponding to the manipulation states (manual opening signal, manual closing signal, neutral signal) are input to the control unit 1 via a switch input detection unit 7 in the power window devices 10P, 10R, and 10L for the sub seats. Then, the control unit 1 controls the drive of the motors Mp, Mr, and Ml by the motor drive unit 3 based on the input signal to open and close or stop opening and closing the windows Wp, Wr, and Wl in a manual mode.

When the manipulation switch SWd on the main seat is switched, signals corresponding to the manipulation states (manual opening signal, auto opening signal, manual closing signal, auto closing signal, neutral signal) are input to the control unit 1*x* via a switch input detection unit 7*d* in the power window devices 10D for the main seat. After that, the control unit 1*x* controls the drive of the motor Md by the motor drive unit 3 based on the input signal to open and close or stop opening and closing the window Wd in a manual mode.

Further, when the manipulation switches SWdp, SWdr, and SWdl on the main seat is switched, signals corresponding to the manipulation states (manual opening signal, manual closing signal, neutral signal) are input to the control unit 1*x* via switch input detection units 7*p*, 7*r*, and 7*l* in the power window devices 10D for the main seat. Then, the control unit 1*x* generates an operation instruction signal (opening instruction signal, closing instruction signal, or stop instruction signal) of the windows Wp, Wr, and Wl on the sub seats based on the input signal. The control unit 1*x* transmits the operation instruction signal to the power window devices 10P, 10R, and 10L for the sub seats via the communication unit 6 and the communication bus 30. At this time, the operation instruction signal includes identification information of the destination power window devices 10P, 10R, and 10L and information indicating the windows Wp, Wr, and Wl to be operated.

The power window devices 10P, 10R, and 10L for the sub seats receive the operation instruction signals of the windows Wp, Wr, and Wl transmitted from the power window device 10D for the main seat by the communication unit 6. The control unit 1 controls the drive of the motors Mp, Mr, and Ml by the motor drive unit 3 based on the operation instruction signal to open and close or stop opening and closing the windows Wp, Wr, and Wl in a manual mode.

At that time, when the motors Mp, Mr, and Ml are driven based on the closing instruction signal received from the power window device 10D for the main seat and the closing operation is performed on the windows Wp, Wr, and Wl, the control unit 1 turns on the closing operation flag 2*a* stored in the storage unit 2 in order to record the operation content. In addition, when the motors Mp, Mr, and Ml are driven based on the opening instruction signal received from the power window device 10D for the main seat and the opening operation is performed on the windows Wp, Wr, and Wl, the control unit 1 turns on the opening operation flag 2*b* stored in the storage unit 2 in order to record the operation content.

Further, when the motors Mp, Mr, and Ml are stopped based on the stop instruction signal received from the power window device 10D for the main seat and the opening/closing operation of the windows Wp, Wr, and Wl is stopped, the control unit 1 turns off the closing operation flag 2*a* or the opening operation flag 2*b* in an ON state in order to record the operation content. Since the windows Wp, Wr, and Wl become the fully open state or fully closed state, the control unit 1 turns off the closing operation flag 2*a* or the opening operation flag 2*b* in an ON state when the opening/closing operation is stopped or when the opening/closing operation of the windows Wp, Wr, and Wl is stopped by a trigger other than the stop instruction signal. The storage unit 2 is an example of an "operation record unit" according to one or more embodiments of the inventions.

In the power window devices 10P, 10R, and 10L for the sub seats, while receiving the opening instruction signal (opening instruction signal or closing instruction signal) of the windows Wp, Wr, and Wl from the power window device 10D for the main seat by the communication unit 6, the control unit 1 drives the motors Mp, Mr, and Ml to execute a manual mode (as-needed opening/closing operation) for opening and closing the windows Wp, Wr, and Wl. During opening and closing the windows Wp, Wr, and Wl in a manual mode, the signal abnormality determination unit if determines the presence/absence of an abnormality in the opening/closing instruction signal. When it is determined that there is an abnormality in the opening/closing instruction signal, the signal abnormality determination unit if measures a duration of the abnormality, and determines that the abnormal state of the opening/closing instruction signal is confirmed when the duration is equal to or longer than a predetermined confirmation time. The confirmation time is stored in the storage unit 2. Further, the determination result of the signal abnormality determination unit if is recorded in the storage unit 2 by the control unit 1 as needed.

Figure 4:
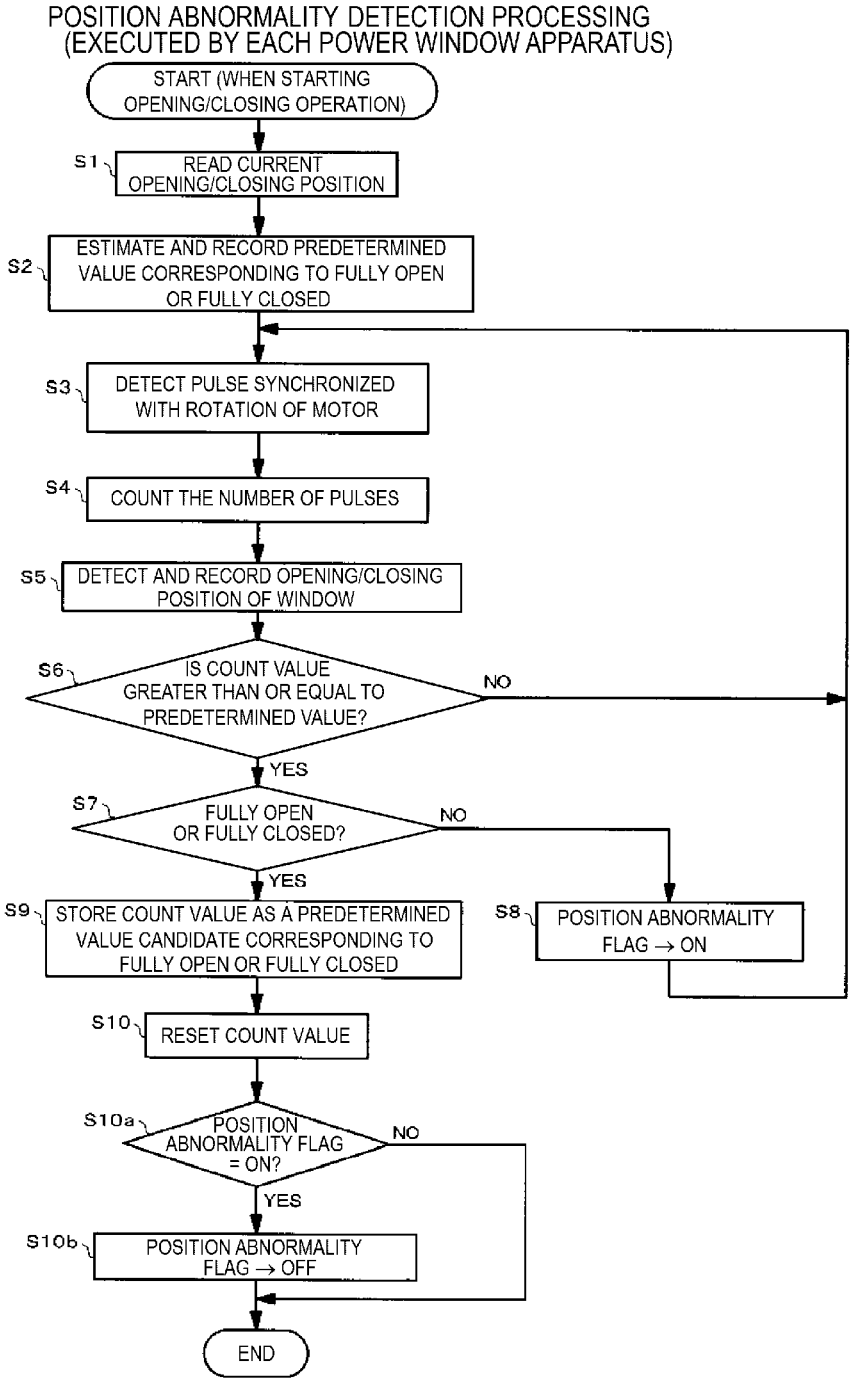
FIG. 4 is a flowchart showing a procedure of position abnormality detection processing by the power window device in FIG. 1.

FIG. 4 is a flowchart showing a procedure of position abnormality detection processing by the power window devices 10D, 10P, 10R, and 10L.

In the power window devices 10D, 10P, 10R, and 10L, the control units 1*x* read the opening/closing positions of the current windows Wd, Wp, Wr, and Wl recorded in the storage units 2*x* and 2 (step S1) when the opening/closing operation of the windows Wd, Wp, Wr, and Wl by driving the motors Md, Mp, Mr, and Ml is started (immediately before the start). The control units 1*x* and 1 estimate a count value of pulses from the current opening/closing position of the windows Wd, Wp, Wr, and Wl until reaching the fully open state or the fully closed state that is the end of the current operation, and record the estimated values in the storage units 2*x* and 2 as predetermined values corresponding to the fully open state or the fully closed state (step S2).

Next, when the motors Md, Mp, Mr, and Ml are driven, the control units 1*x* and 1 detect pulses synchronized with the rotation of the motors Md, Mp, Mr, and Ml by the pulse detection unit 4 based on the ripple included in the motor current detected by the motor current detection unit 5 (step S3). Then, the position detection unit la counts the number of pulses detected by the pulse detection unit 4 (step S4), and based on the count value, detects the opening/closing positions of the windows Wd, Wp, Wr, and Wl, and records (updates) the detected positions in the storage units 2*x* and 2 (step S5).

Next, the control units 1*x* and 1 read out the predetermined values corresponding to the fully open state or the fully closed state recorded in step S2 from the storage units 2*x* and 2 and compare the read predetermined values with the count value from the position detection unit la (step S6). At this time, when the count value from the position detection unit la is less than the predetermined value (step S6: NO), the process returns to step S3 and the subsequent processing is repeated.

When the count value from the position detection unit 1*a* becomes equal to or greater than the predetermined value (step S6: YES), no pulse is detected by the pulse detection unit 4 and when it is detected whether the windows Wd, Wp, Wr, and Wl are in the fully open state or the fully closed state by the position detection unit 1*a* (step S7: YES), the control units 1*x* and 1 record the count value from the position detection unit 1*a* in the storage units 2*x* and 2 as candidates for a predetermined value corresponding to the fully open state or the fully closed state (step S9). Thereafter, the control units 1*x* and 1 reset the count value from the position detection unit 1*a* (step S10), and end the processing when the position abnormality flags 2*c* in the storage units 2*x* and 2 are in the off state (step S10*a*: NO).

On the other hand, the motor current detected by the motor current detection unit 5 may include not only ripples synchronized with the rotation of the motors Md, Mp, Mr, and Ml but also noise based on disturbances or the like. Therefore, the pulse detection unit 4 also detects noise included in the motor current as a pulse, and there is a possibility that an abnormality occurs in which the opening/closing positions of the windows Wd, Wp, Wr, and Wl detected by the position detection unit 1*a* based on the pulse are deviated from the actual opening/closing positions of the windows Wd, Wp, Wr, and Wl. For example, although the windows Wd, Wp, Wr, and Wl are not actually in the fully open state or the fully closed state, the pulse count value may be equal to or greater than the predetermined value corresponding to the fully open state or the fully closed state. Such an abnormality in the opening/closing position due to noise is more likely to occur than an abnormality in the opening/closing position due to other causes.

Even though the count value of the position detection unit la is equal to or greater than the predetermined value (step S6: YES), when the pulse is continuously detected by the pulse detection unit 4 and the position detection unit 1*a* detects that the windows Wd, Wp, Wr, and Wl are not in the fully open state or fully closed state (step S7: NO), the position abnormality determination unit 1*c* determines that there is an abnormality in the opening/closing positions of the windows Wd, Wp, Wr, and Wl detected by the position detection unit 1*a*, and turns on the position abnormality flag 2*c* in the storage units 2*x* and 2 (step S8). Then, the subsequent processing from step S3 is repeated until the windows Wd, Wp, Wr, and Wl become the fully open state or fully closed state.

When the position detection unit la detects that the windows Wd, Wp, Wr, and Wl are in the fully open state or the fully closed state (step S7: YES), the control units 1*x* and 1 record the count value from the position detection unit 1*a* in the storage units 2*x* and 2 as candidates for a predetermined value corresponding to the fully open state or the fully closed state (step S9). Then, the control units 1*x* and 1 reset the count value from the position detection unit 1*a* (step S10), check that the position abnormality flag 2*c* is in an ON state (step S10*a*: YES), turn off the position abnormality flag 2*c* to dissolve the abnormal state of the opening/closing position detected by the position detection unit 1*a* (step S101)), and end the process.

Figure 5:
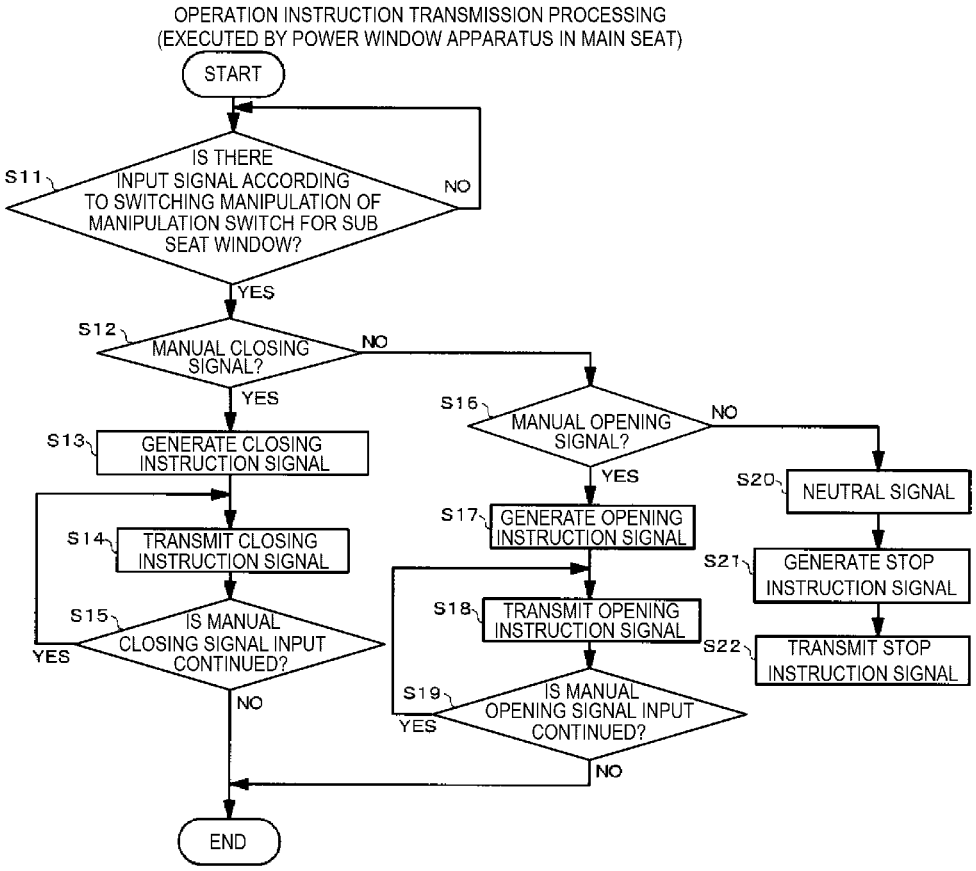
FIG. 5 is a flowchart showing a procedure of operation instruction transmission processing by the power window device for the main seat in FIG. 1.

FIG. 5 is a flowchart showing a procedure of operation instruction transmission processing by the power window device 10D for the main seat.

When one of the manipulation switches SWdp, SWdr, and SWdl for the windows Wp, Wr, and Wl for the sub seats provided on the main seat is switched, a signal corresponding to the manipulation state is input to the control unit 1*x* via the switch input circuits 7*p,* 7*r,* and 7*l* of the power window device 10D for the main seat (step S11: YES). When the input signal is a manual closing signal (step S12: YES), the control unit 1*x* generates closing instruction signals of the windows Wp, Wr, and Wl for the sub seats corresponding to the manipulation switches SWdp, SWdr, and SWdl, which are the input sources (step S13). The control unit 1*x* transmits the closing instruction signals from the communication unit 6 to the power window devices 10P, 10R, and 10L for the corresponding sub seats via the communication bus 30 (step S14). The transmission of the closing instruction signals are continued or repeated at a predetermined cycle while the manual closing signals are continuously input from the same manipulation switches SWdp, SWdr, and SWdl (step S15: YES).

On the other hand, when the input signal from any of the manipulation switches SWdp, SWdr, and SWdl is a manual opening signal (step S16: YES), the control unit 1*x* generates opening instruction signals of the windows Wp, Wr, and Wl for the sub seats corresponding to the manipulation switches SWdp, SWdr, and SWdl, which are the input sources (step S17). The control unit 1*x* transmits the opening instruction signals from the communication unit 6 to the power window devices 10P, 10R, and 10L for the corresponding sub seats via the communication bus 30 (step S18). The transmission of the opening instruction signals are continued or repeated at a predetermined cycle while the manual opening signals are continuously input from the same manipulation switches SWdp, SWdr, and SWdl (step S19: YES).

Further, when the input signal from any of the manipulation switches SWdp, SWdr, and SWdl is a neutral signal (step S20), the control unit 1*x* generates stop instruction signals of the windows Wp, Wr, and Wl for the sub seats corresponding to the manipulation switches SWdp, SWdr, and SWdl, which are the input sources (step S21). The control unit 1*x* transmits the stop instruction signals from the communication unit 6 to the power window devices 10P, 10R, and 10L for the corresponding sub seats via the communication bus 30 (step S22). The transmission of the stop instruction signal may be continued, repeated at a predetermined cycle, or temporarily executed while the neutral signals are continuously input from the same manipulation switches SWdp, SWdr, and SWdl.

Figure 6:
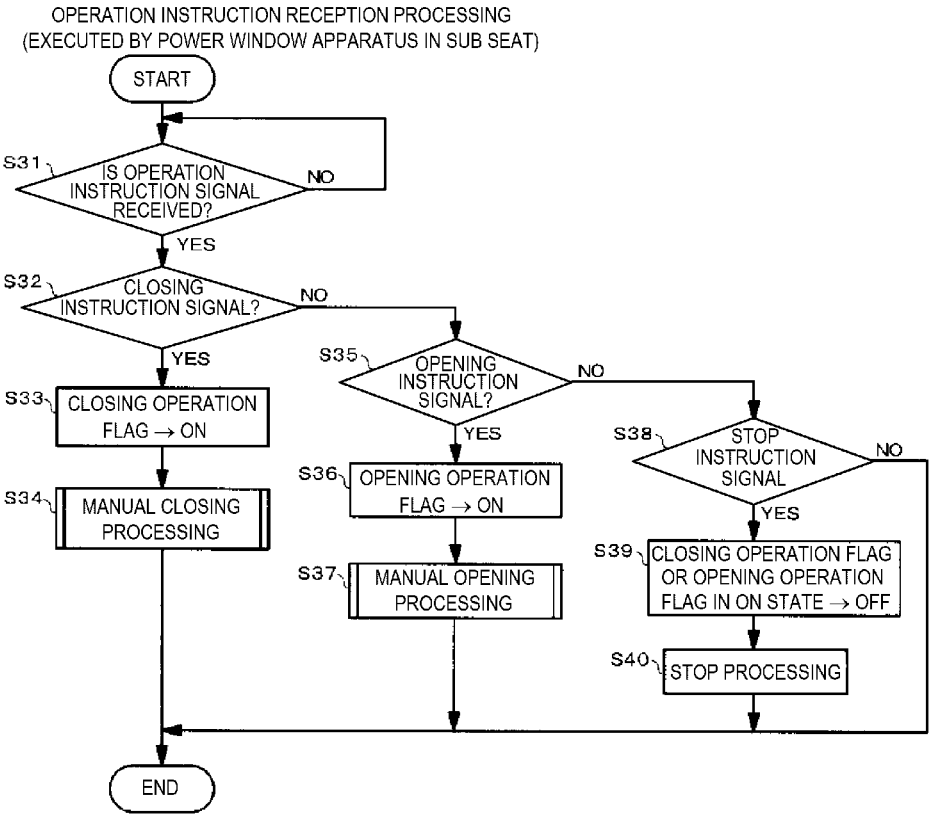
FIG. 6 is a flowchart showing a procedure of operation instruction reception processing by the power window device for the sub seat in FIG. 1.

FIG. 6 is a flowchart showing a procedure of operation instruction reception processing by the power window devices 10P, 10R, and 10L for the sub seats.

The power window devices 10P, 10R and 10L for the sub seats receive the operation instruction signals of the corresponding windows Wp, Wr and Wl transmitted from the power window device 10D for the main seat by the communication unit 6 via the communication bus 30. (Step S31: YES). When the received operation instruction signals are the closing instruction signals (step S32: YES), the control unit 1 turns on the closing operation flag 2*a* stored in the storage unit 2 (step S33) and executes manual closing processing based on the closing instruction signals (step S34).

In addition, when the received operation instruction signals are the opening instruction signals (step S35: YES), the control unit 1 turns on the opening operation flag 2*b* stored in the storage unit 2 (step S36) and executes manual opening processing based on the opening instruction signals (step S37).

Further, when the received operation instruction signals are stop instruction signals (step S38: YES), the control unit 1 turns off the closing operation flag 2*a* or the opening operation flag 2*b* in an ON state (step S39), and executes stop processing based on the stop instruction signals (step S40).

In the stop processing in step S40, the control unit 1 stops the drive of the corresponding motors Mp, Mr, and Ml by the motor drive unit 3 based on the received stop instruction signals, and stops the opening operation or the closing operation of the corresponding windows Wp, Wr, and Wl. Details of the manual closing processing in step S34 and details of the manual opening processing in step S37 will be described later.

Figure 7A:
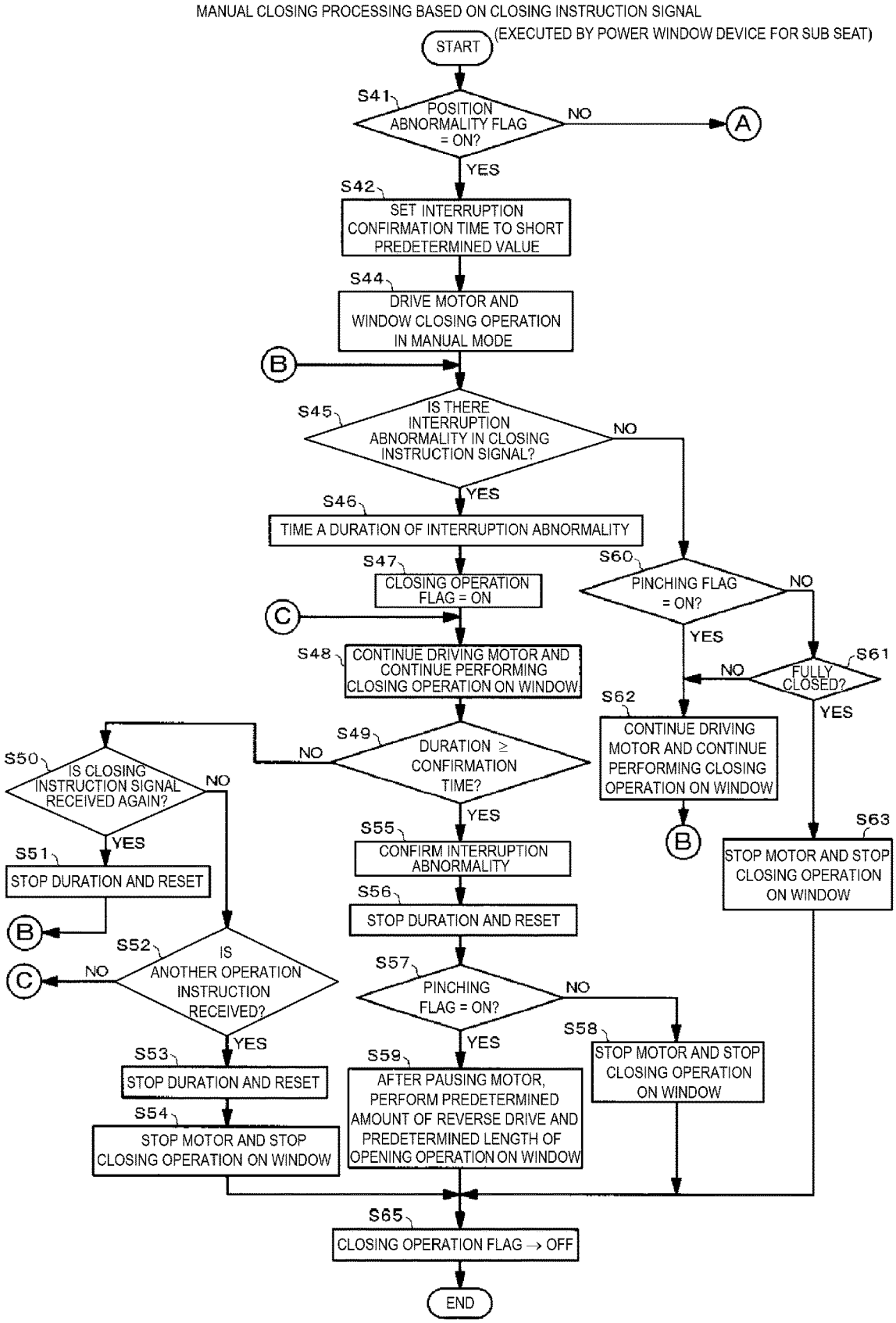
FIG. 7A is a flowchart showing a procedure of manual closing processing in FIG. 6.
Figure 7B:
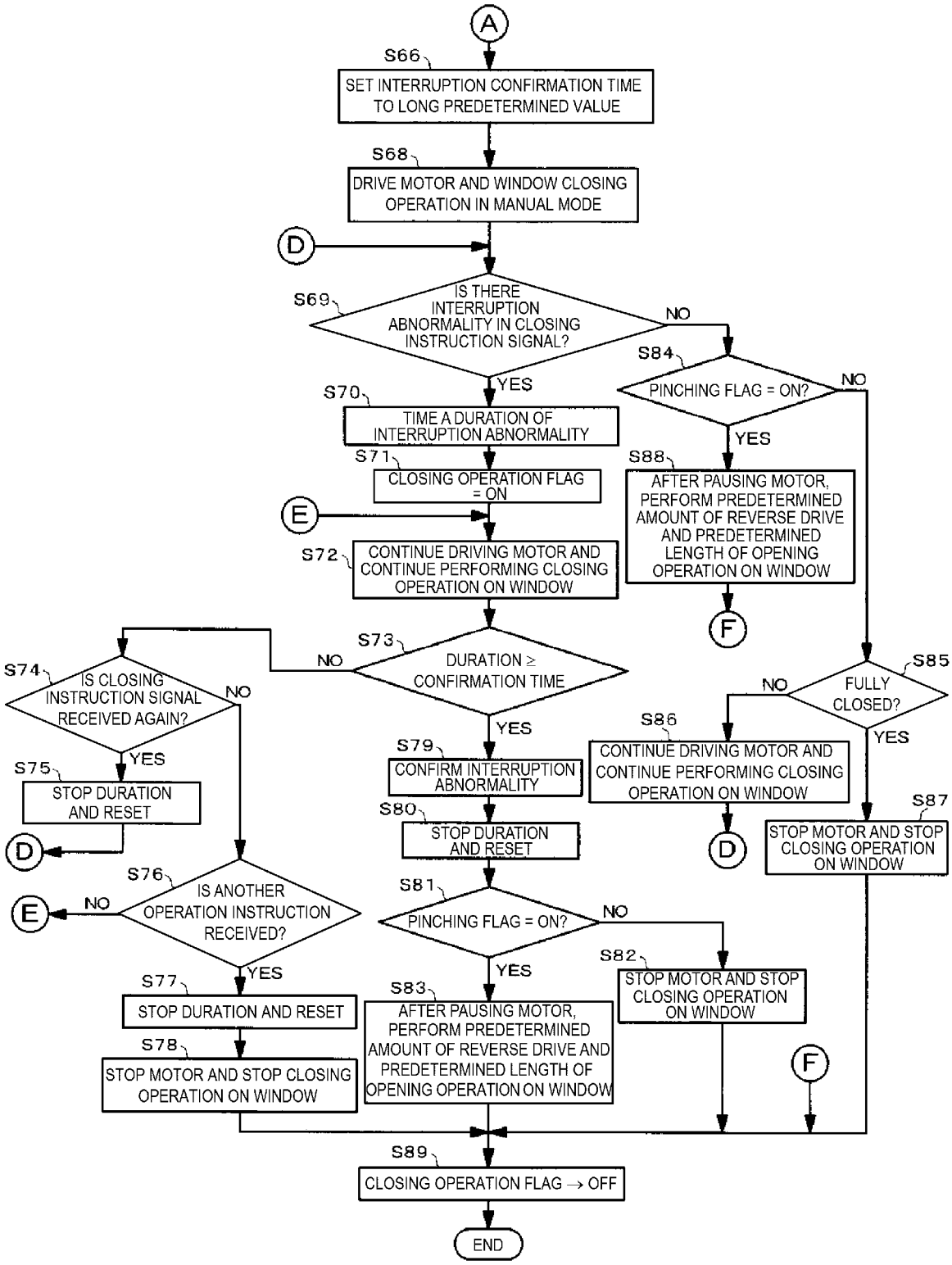
FIG. 7B is a flowchart subsequent to FIG. 7A.

FIGS. 7A and 7B are flowcharts showing a procedure of the manual closing processing based on the closing instruction signal in FIG. 6 (step S34).

First, when the position abnormality flag 2*c* stored in the storage unit 2 of the power window devices 10P, 10R, and 10L for the sub seats is in an OFF state (step S41 in FIG. 7A: NO), since there is no abnormality in the opening/closing positions of the windows Wp, Wr, and Wl detected by the position detection unit 1*a,* the control unit 1 sets a confirmation time, that is compared with a duration of the interruption abnormality described later, to a long predetermined value (step S66 in FIG. 7B). Then, the control unit 1 drives the motors Mp, Mr, and Ml to rotate forward based on the closing instruction signal received by the communication unit 6, and performs the closing operation of the windows Wp, Wr, and Wl in a manual mode (step S68).

During the closing operation of the windows Wp, Wr, and Wl in a manual mode, for example, due to disturbance such as vibrations or shocks, disconnection or short of communication wiring, failure of the power window device 10D, or disconnection of the communication bus, an abnormality may occur in which the closing instruction signal from the power window device 10D is interrupted in the power window devices 10P, 10R, and 10L. The interruption abnormality in the closing instruction signal is more likely to occur than other abnormalities in the closing instruction signals. Therefore, the presence/absence of an interruption abnormality in the closing instruction signal is determined by the signal abnormality determination unit 1*f.*

When there is no interruption abnormality in the closing instruction signal (step S69: NO), the control unit 1 checks the state of the pinching flag 2*e* stored in the storage unit 2 (step S84). At this time, when the pinching flag 2*e* is in an OFF state (step S84: NO), since there is no foreign object pinched in the windows Wp, Wr, and Wl, the control unit 1 checks whether or not the windows Wp, Wr, and Wl, during the closing operation, are in the fully closed state (step S85). Here, when it is determined that the windows Wp, Wr, and Wl, during the closing operation, are not in the fully closed state by the position detection unit 1*a* (step S85: NO), the control unit 1 continues to drive the motors Mp, Mr, and Ml and continues the closing operation of the windows Wp, Wr, and Wl (step S86). Thereafter, the process proceeds to step S69. In contrast to this, when it is determined that the windows Wp, Wr, and Wl, during the closing operation, are in the fully closed state (step S85: YES), the control unit 1 stops to drive the motors Mp, Mr, and Ml and stops the closing operation of the windows Wp, Wr, and Wl (step S87). Then, the control unit 1 turns off the closing operation flag 2*a* (step S89), and the process is ended.

In addition, when the pinching flag 2*e* is turned on (step S84: YES) without the occurrence of an interruption abnormality in the closing instruction signal (step S69: NO), since a foreign object is pinched in the windows Wp, Wr, and Wl, the control unit 1 temporarily stops the motors Mp, Mr, and Ml, reversely drives the motors Mp, Mr, and Ml by a predetermined amount, and performs the opening operation of the windows Wp, Wr, and Wl by a predetermined length (step S88). Thereafter, the control unit 1 turns off the closing operation flag 2*a* (step S89), and the process is ended.

In addition, when an interruption abnormality occurs in the closing instruction signal, the signal abnormality determination unit if determines that there is an interruption abnormality in the closing instruction signal (step S69: YES), and a duration of the interruption abnormality is measured (step S70). At this time, the control unit 1 checks that the closing operation flag 2*a* is in the ON state (step S71), continues the drive of the motors Mp, Mr, and Ml, and continues the closing operation of the windows Wp, Wr, and Wl. (Step S72). When the duration of the interruption abnormality measured by the signal abnormality determination unit 1*f* is less than the confirmation time, which is set long, in step S66 (step S73: NO), the control unit 1 checks whether or not the closing instruction signal is received again by the communication unit 6, or whether or not another operation instruction signal (opening instruction signal or stop instruction signal) is received by the communication unit 6 (step S74).

When the closing instruction signal is received again by the communication unit 6 (step S74: YES), the measurement of the duration of the interruption abnormality by the signal abnormality determination unit 1*f* is stopped and the duration is reset (step S75), and the process proceeds to S69. On the other hand, when the closing instruction signal is not received again by the communication unit 6 (step S74: NO) and the other operation instruction signal is received (step S76: YES), as in step S75, the measurement of the duration of the interruption abnormality is stopped, the duration is reset (step S77), and then the control unit 1 stops driving the motors Mp, Mr, and Ml, and stops the closing operation of the windows Wp, Wr and Wl (step S78). Then, the control unit 1 turns off the closing operation flag 2*a* (step S89), and the process is ended. Thereafter, the operation instruction reception processing in FIG. 6 is executed, and the manual opening processing or the stop processing is executed based on the received other operation instruction signal. When the closing instruction signal is not received again by the communication unit 6 (step S74: NO) and the other operation instruction signal is not also received (step S76: NO), the process proceeds to step S72.

When the duration of the interruption abnormality measured by the signal abnormality determination unit if is equal to or longer than the confirmation time (step S73: YES), it is determined that the interruption abnormality state is confirmed by the signal abnormality determination unit 1*f* (step S79), the measurement of the duration of the interruption abnormality is stopped, and the duration is reset (step S80).

After that, when the pinching flag 2*e* is in an OFF state (step S81: NO), since there is no foreign object pinched in the windows Wp, Wr, and Wl, the control unit 1 stops the drive of the motors Mp, Mr, and Ml, and stops the closing operation of the windows Wp, Wr, and Wl (step S82). Then, the control unit 1 turns off the closing operation flag 2*a* (step S89), and the process is ended. In the contrast to this, when the pinching flag 2*e* is in an ON state (step S81: YES), since a foreign object is pinched in the windows Wp, Wr, and Wl, the control unit 1 temporarily stops the motors Mp, Mr, and Ml, reversely drives the motors Mp, Mr, and Ml by a predetermined amount, and performs the opening operation of the windows Wp, Wr, and Wl by a predetermined length (step S83). As a result, the pinching state of a foreign object in the windows Wp, Wr, and Wl is released. Then, the control unit 1 turns off the closing operation flag 2*a* (step S89), and the process is ended.

Note that since the state of the pinching flag 2*e* is not checked by the control unit 1 from the time when an interruption abnormality in the closing instruction signal occurs (step 69: YES) until the duration of the interruption abnormality is reset (step S75, step S77, and step S80), even when a foreign object is pinched, the drive of motors Mp, Mr, and Ml are continued, and the closing operation of the windows Wp, Wr, and Wl are continued.

It is preferable that the predetermined amount for reversely driving the motor and the predetermined length for opening the window in step S83 when an interruption abnormality in the closing instruction signal occurs (step S69: YES) and the pinching flag is in an ON state (step S81: YES) are smaller than the predetermined amount for reversely driving the motor and the predetermined length for opening the window in step S88 when an interruption abnormality in the closing instruction signal does not occur (step S69: NO) and the pinching flag is in an ON state (step S84: YES). In addition, it is preferable that the predetermined amount for reversely driving the motor and the predetermined length for opening the window in step S59 in FIG. 7A described later are similarly reduced.

On the other hand, when the position abnormality flag 2*c* is in an ON state (step S41 in FIG. 7A: YES), since there is an abnormality in the opening/closing positions of the windows Wp, Wr, and Wl detected by the position detection unit 1*a*, the control unit 1 sets the confirmation time to a short predetermined value (step S42).

Then, the control unit 1 drives the motors Mp, Mr, and Ml based on the closing instruction signal received by the communication unit 6, and performs the closing operation of the windows Wp, Wr, and Wl in a manual mode (step S44). During the closing operation, when there is no interruption abnormality in the closing instruction signal (step S45: NO), the control unit 1 checks the state of the pinching flag 2*e* (step S60).

At this time, when the pinching flag 2*e* is in an OFF state (step S60: NO), since there is no foreign object pinched in the windows Wp, Wr, and Wl, the control unit 1 checks whether or not the windows Wp, Wr, and Wl, during the closing operation, are in the fully closed state (step S61). Here, when it is determined that the windows Wp, Wr, and Wl, during the closing operation, are not in the fully closed state (step S61: NO), the control unit 1 continues to drive the motors Mp, Mr, and Ml and continues the closing operation of the windows Wp, Wr, and Wl (step S62). Thereafter, the process proceeds to step S45. In contrast to this, when the windows Wp, Wr, and Wl, during the closing operation, are in the fully closed state (step S61: YES), the control unit 1 stops to drive the motors Mp, Mr, and Ml and stops the closing operation of the windows Wp, Wr, and Wl (step S63). Then, the control unit 1 turns off the closing operation flag 2*a* (step S65), and the process is ended.

In addition, when the pinching flag 2*e* is turned on (step S60: YES) without the occurrence of an interruption abnormality in the closing instruction signal (step S45: NO), the control unit 1 continues to drive the motors Mp, Mr, and Ml and continues the closing operation of the windows Wp, Wr, and Wl (step S62), and the process proceeds to step S45. In this case, since the manipulation of the manipulation switches SWp, SWr, SWl, SWdp, SWdr, and SWdl for the windows Wp, Wr, and Wl for the sub seats becomes valid, a user, who notices that a foreign object is pinched in the windows Wp, Wr, and Wl, operates the operation switches SWp, SWr, SWl, SWdp, SWdr, and SWdl to the neutral position or the manual opening position, thereby the motors Mp, Mr, and Ml are temporarily stopped and then are reversely driven. Therefore, it is possible to release the pinching by performing the opening operation of the windows Wp, Wr, and Wl.

As another example, when the pinching flag 2*e* is in an ON state (step S60: YES) without the occurrence of an interruption abnormality in the closing instruction signal (step S45: NO), the motors Mp, Mr, and Ml may be temporarily stopped and then reversely driven by the predetermined amount, and the opening operation is performed on the windows Wp, Wr, and Wl by the predetermined length.

In addition, when an interruption abnormality occurs in the closing instruction signal, the signal abnormality determination unit if determines that there is an interruption abnormality in the closing instruction signal (step S45: YES), and a duration of the interruption abnormality is measured (step S46). Further, the control unit 1 checks that the closing operation flag 2*a* is in the ON state (step S47), continues to drive the motors Mp, Mr, and Ml, and continues the closing operation of the windows Wp, Wr, and Wl. (Step S48).

Then, the duration of the interruption abnormality measured by the signal abnormality determination unit if is less than the confirmation time set short in step S42 (step S49: NO), and the closing instruction signal is received again by the communication unit 6 (step S50): YES), the measurement of the duration of the interruption abnormality by the signal abnormality determination unit 1f is stopped and the duration is reset (step S51), and the process proceeds to S45. In the contrast to this, when the duration of the interruption abnormality is less than the confirmation time (step S49: NO), the closing instruction signal is not received again by the communication unit 6 (step S50: NO), and the other operation instruction signal is received (step S52: YES), similar to step S51, the measurement of the duration of the interruption abnormality by the signal abnormality determination unit if is stopped and the duration is reset (step S53). Then, the control unit 1 stops driving the motors Mp, Mr, and Ml, stops the closing operation of the windows Wp, Wr, and Wl (step S54), and turns off the closing operation flag 2*a* (step S65), and then the process is ended. Thereafter, the operation instruction reception processing in FIG. 6 is executed, and the manual opening processing or the stop processing is executed based on the received other operation instruction signal. When the closing instruction signal is not received again by the communication unit 6 (step S50: NO) and the other operation instruction signal is not also received (step S52: NO), the process proceeds to step S48.

When the duration of the interruption abnormality measured by the signal abnormality determination unit if is equal to or longer than the confirmation time (step S49: YES), it is determined that the interruption abnormality state is confirmed by the signal abnormality determination unit if (step S55), the measurement of the duration of the interruption abnormality is stopped, and the duration is reset (step S56). After that, when the pinching flag 2*e* is in an OFF state (step S57: NO), the control unit 1 stops the drive of the motors Mp, Mr, and Ml, and stops the closing operation of the windows Wp, Wr, and Wl (step S58). Then, the control unit 1 turns off the closing operation flag 2*a* (step S65), and the process is ended. In the contrast to this, when the pinching flag 2*e* is in an ON state (step S57: YES), since a foreign object is pinched in the windows Wp, Wr, and Wl, the control unit 1 temporarily stops the motors Mp, Mr, and Ml, reversely drives the motors Mp, Mr, and Ml by a predetermined amount, and performs the opening operation of the windows Wp, Wr, and Wl by a predetermined length (step S59). As a result, the pinching state of a foreign object in the windows Wp, Wr, and Wl is released. Then, the control unit 1 turns off the closing operation flag 2*a* (step S65), and the process is ended.

Note that since the state of the pinching flag 2*e* is not checked by the control unit 1 from the time when an interruption abnormality in the closing instruction signal occurs (step 45: YES) until the duration of the interruption abnormality is reset (step S51, step S53, and step S56), even when a foreign object is pinched, the drive of motors Mp, Mr, and Ml are continued, and the closing operation of the windows Wp, Wr, and Wl are continued.

Figure 8A:
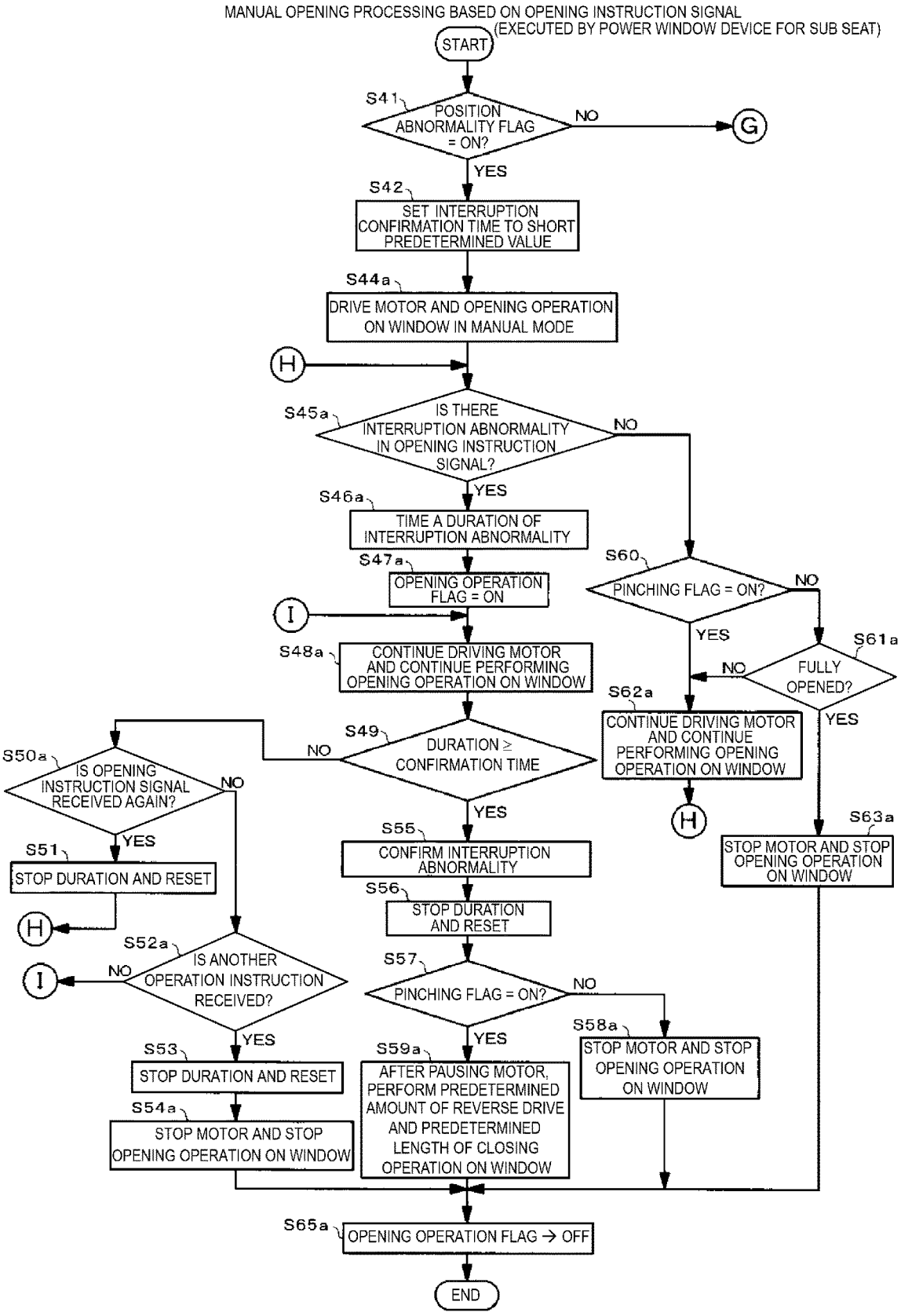
FIG. 8A is a flowchart showing a procedure of manual opening processing in FIG. 6.
Figure 8B:
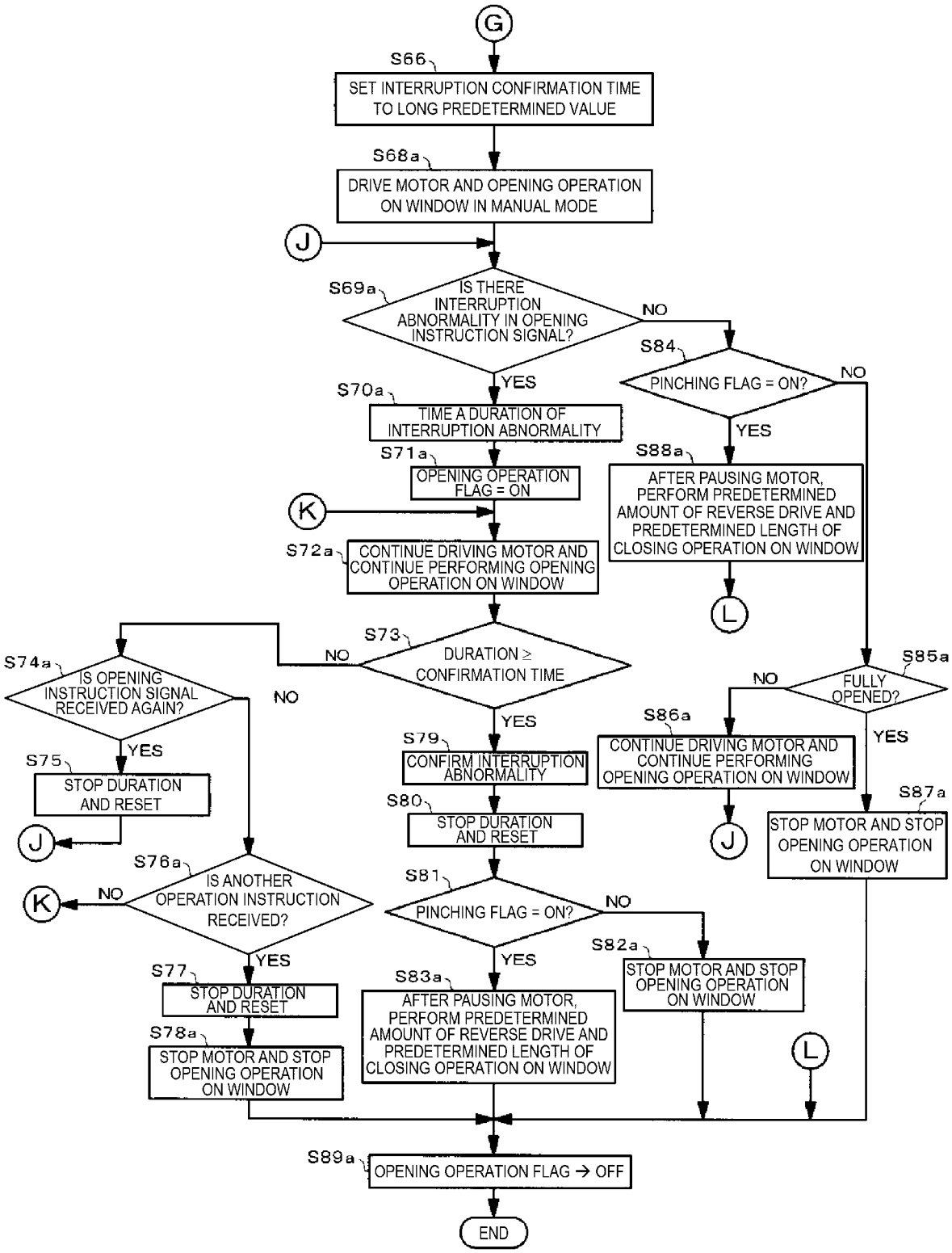
FIG. 8B is a flowchart subsequent to FIG. 8A.

FIGS. 8A and 8B are flowcharts showing a procedure of the manual opening processing based on the opening instruction signal in FIG. 6 (step S37). In FIGS. 8A and 8B, the same processing as those in FIGS. 7A and 7B are denoted by the same reference numerals. Hereinafter, it demonstrates centering on a different point from the manual closing processing in FIGS. 7A and 7B.

In the manual opening processing in FIGS. 8A and 8B, after the confirmation time is set according to the state of the position abnormality flag 2*c* (step S42 in FIG. 8A and step S66 in FIG. 8B), the motors Mp, Mr, and Ml are reversely driven based on the opening instruction signal received by the communication unit 6 and the opening operation is performed on the windows Wp, Wr, and Wl in a manual mode (step S44*a* in FIG. 8A and step S68*a* in FIG. 8B).

Even during the opening operation is performed on the windows Wp, Wr, and Wl in a manual mode, due to disturbance, failure, or disconnection of the communication bus, an interruption abnormality, in which the opening instruction signal from the power window device 10D is not received in the power window devices 10P, 10R, and 10L, may occur. The interruption abnormality in the opening instruction signal is more likely to occur than other abnormalities in the opening instruction signals. Therefore, the presence/absence of an interruption abnormality in the opening instruction signal is determined by the signal abnormality determination unit 1*f*.

Then, when the interruption abnormality in the opening instruction signal does not occur (step S45*a* in FIG. 8A: NO and step S69*a* in FIG. 8B: NO), the pinching flag 2*e* is in an OFF state (step S60 in FIG. 8A: NO and step S84 in FIG. 8B), and the windows Wp, Wr, and Wl, during the opening operation, are not in a fully open state (step 561*a* in FIG. 8A: NO and step S85*a* in FIG. 8B: NO), the drive of the motors Mp, Mr, and Ml is continued, and the opening operation of the windows Wp, Wr, and Wl is continued (step S62*a* in FIG. 8A, step S86*a* in FIG. 8B). When the windows Wp, Wr, and Wl, during the opening operation, are in a fully open state (step S61*a* in FIG. 8A: YES and step S85*a*: YES in FIG. 8B), the drive of the motors Mp, Mr, and Ml is stopped, and the opening operation of the window Wp, Wr and Wl is stopped (step S63*a* in FIG. 8A, step S87*a* in FIG. 8B).

In addition, in a case where the position abnormality flag 2*c* is in an OFF state (step S41 in FIG. 8A: NO), when an interruption abnormality in the opening instruction signal does not occur (step S69*a*: NO in FIG. 8B) and the pinching flag 2*e* is in an ON state (step S84: YES), the motors Mp, Mr, and Ml are temporarily stopped and then reversely driven (forward) by a predetermined amount, and the closing operation is performed on the windows Wp, Wr, and Wl by a predetermined length (step S88*a*).

In addition, in a case where the position abnormality flag 2*c* is in an ON state (step S41 in FIG. 8A: YES), when an interruption abnormality in the opening instruction signal does not occur (step S45*a*: NO) and the pinching flag 2*e* is in an ON state (step S60: YES), the drive of motors Mp, Mr, and Ml is continued and the opening operation of the windows Wp, Wr, and Wl is continued (step S62*a*).

When an interruption abnormality in the opening instruction signal occurs, the signal abnormality determination unit if determines that there is an interruption abnormality in the opening instruction signal (step S45*a* in FIG. 8A: YES and step S69*a* in FIG. 8B: YES) and measures the duration of the interruption abnormality (step S46*a* in FIG. 8A and step S70*a* in FIG. 8B). At this time, the control unit 1 checks that the opening operation flag 2*b* is in an ON state (step S47*a* in FIG. 8A and step 571*a* in FIG. 8B), continues the drive of the motors Mp, Mr, and Ml, and continues the opening operation of the windows Wp, Wr, and Wl (step S48*a* in FIG. 8A and step S72*a* in FIG. 8B).

Then, the presence/absence of the re-reception of the opening instruction signal (steps S50*a* in FIG. 8A and step S74*a* in FIG. 8B) or the presence/absence of the reception of the other operation instruction signal (closing instruction signal or stop instruction signal) is checked until the duration of the interruption abnormality becomes equal to or longer than the confirmation time (step S49 in FIG. 8A: NO, step S73 in FIG. 8B: NO). Here, when the other operation instruction signal is received (step S52*a* in FIG. 8A: YES and step S76*a* in FIG. 8B: YES) without receiving the opening instruction signal again (step S50*a* in FIG. 8A: NO and step S74*a* in FIG. 8B: NO), the drive of the motors Mp, Mr, and Ml is stopped, and the opening operation of the windows Wp, Wr, and Wl is stopped (step S54*a* in FIG. 8A and step S78*a* in FIG. 8B).

In addition, when the duration of the interruption abnormality is equal to or longer than the confirmation time (step S49 in FIG. 8A: YES and step S73 in FIG. 8B: YES) and the state of an interruption abnormality is confirmed (step S55 in FIG. 8A and step S79 in FIG. 8B), and the pinching flag 2*e* is in an OFF state (step S57 in FIG. 8A: NO and step S81 in FIG. 8B: NO), the drive of the motors Mp, Mr, and Ml is stopped, and the opening operation of the windows Wp, Wr, and Wl is stopped (step S58*a* in FIG. 8A and step S82*a* in FIG. 8B). In the contrast to this, when the pinching flag 2*e* is in an ON state (step S57 in FIG. 8A: YES and step S81 in FIG. 8B), the motors Mp, Mr, and Ml are temporarily stopped and then reversely driven by a predetermined amount, and the closing operation is performed on the windows Wp, Wr, and Wl by a predetermined length (step S59*a* in FIG. 8A, step S83*a* in FIG. 8B).

Further, after stopping of the opening operation of the windows Wp, Wr, and Wl (step S54*a*, step S58*a*, step S63*a* in FIG. 8A, step 578*a*, step S82*a*, and step S87*a* in FIG. 8B), or after performing the closing operation of the windows Wp, Wr, and Wl by a predetermined length (step S59*a* in FIG. 8A, step S83*a* in FIG. 8B, and step S88*a*), the opening operation flag 2*b* is turned off (step S65*a* in FIG. 8A, step S89*a* in FIG. 8B).

According to the above embodiment, in the power window devices 10P, 10R, and 10L for the sub seats, even when an abnormality occurs in the opening/closing position detected by the position detection unit 1*a*, since the opening/closing is executed on the windows Wp, Wr, and Wl are opened or closed in a manual mode based on the opening/closing instruction signal received from the power window device 10D for the main seat by the communication unit 6, user convenience can be ensured. In addition, even in a case where an interruption abnormality occurs in the opening/closing instruction signal during opening and closing the windows Wp, Wr, and Wl in a manual mode, when the duration of the abnormality is not equal or longer than the confirmation time, an interruption abnormality state in the opening/closing instruction signal is not confirmed. The drive of the motors Mp, Mr, and Ml for the sub seats is continued and the opening and closing of the windows Wp, Wr, and Wl is continued until the interruption abnormality state in the opening/closing instruction signal is confirmed, so if the interruption abnormality in the opening/closing instruction signal is temporary or instantaneous, the windows Wp, Wr, Wl are continuously opened or closed without a sense of incongruity, and user convenience can be ensured.

When the duration of the interruption abnormality in the opening/closing instruction signal is equal or longer than the confirmation time during opening/closing in a manual mode based on the opening/closing instruction signal, the interruption abnormality state is confirmed, the motors Mp, Mr, and Ml are stopped, and the opening and closing of the windows Wp, Wr, and Wl is stopped. Therefore, when an interruption abnormality in the opening/closing instruction signal continues for a long time, the windows Wp, Wr, Wl do not continue to open and close involuntarily, so that even when there is a danger of a foreign object being pinched in the windows Wp, Wr, and Wl, the danger can be suppressed or avoided, and safety can be ensured.

In addition, when there is no abnormality in the opening/closing positions of the windows Wp, Wr, and Wl, the duration of the interruption abnormality in the opening/closing instruction signal is compared with the confirmation time which is set long, the time until the interruption abnormality state is confirmed, becomes longer. The user's convenience can be further ensured by continuing to open and close the windows Wp, Wr, and Wl for a while until the interruption abnormality state is confirmed. After confirming that the interruption abnormality state in the opening/closing instruction signal, based on the opening/closing positions of the normal windows Wp, Wr, and Wl detected by the position detection unit 1*a*, the motors Mp, Mr, and Ml can be surely stopped and the opening and closing of the windows Wp, Wr, and Wl can be stopped, thereby even if there is a danger of a foreign object being pinched in the windows Wp, Wr, and Wl, the danger can be suppressed or avoided, and safety can be further improved.

Further, when there is an abnormality in the opening/closing position of the windows Wp, Wr, and Wl, since the duration of the interruption abnormality in the opening/closing instruction signal is compared with the confirmation time which is set short, the interruption abnormality state is confirmed in a short time after the interruption abnormality occurs in the opening/closing instruction signal, thereby the motors Mp, Mr, and Ml can be stopped, and the opening and closing of the windows Wp, Wr, and Wl can be stopped immediately.

Therefore, based on the opening/closing positions of the windows Wp, Wr, and Wl abnormality detected by the position detection unit 1*a*, the time to continue driving the motors Mp, Mr, and Ml, and the time to continue opening and closing the windows Wp, Wr, and Wl are shortened, thereby even if there is a danger of a foreign object being pinched in the windows Wp, Wr, and Wl, the danger can be suppressed or avoided, and safety can be further improved.

In addition, in a case where an interruption abnormality occurs in the opening/closing instruction signal and pinch abnormality occurs by the windows Wp, Wr, and Wl during opening and closing the windows Wp, Wr, and Wl in a manual mode based on the opening/closing instruction signal, when the duration of the interruption abnormality in the opening/closing instruction signal is equal to or longer than the confirmation time then the interruption abnormality state is confirmed. Thereafter, the motors Mp, Mr, and Ml are temporarily stopped and then reversely driven, and the windows Wp, Wr, and Wl are moved in opposite directions. Therefore, the pinching state can be released, and safety is further improved. At that time, when there is an abnormality in the opening/closing position detected by the position detection unit 1*a*, since the confirmation time is set short, the interruption abnormality state is confirmed in a short time after the occurrence of the interruption abnormality in the opening/closing instruction signal, thereby the motors Mp, Mr, and Ml can be reversely driven and the windows Wp, Wr, and Wl can be moved in opposite directions. Therefore, it is possible to immediately suppress an increase in the load of a foreign object pinched by the windows Wp, Wr, and Wl and to release the pinching state, thereby safety can be further improved.

Even in a case where the opening/closing instruction signal is interrupted for a time shorter than the confirmation time during opening and closing the windows Wp, Wr, and Wl in a manual mode based on the opening/closing instruction signal, when a foreign object is pinched by the windows Wp, Wr, and Wl, based on the opening/closing positions of normal windows Wp, Wr, and Wl detected by the position detection unit 1 a, the motors Mp, Mr, and Ml can be temporarily stopped and then reversely driven, and the windows Wp, Wr, and Wl can be moved in opposite directions. Therefore, it is possible to reliably release the pinching state and safety can be further improved.

In a state where there is an abnormality in the opening/closing positions of the windows Wp, Wr, and Wl detected by the position detection unit 1 a, even when a foreign object is pinched by the windows Wp, Wr, and Wl without the occurrence of an interruption abnormality in the opening/closing instruction signal during opening and closing the windows Wp, Wr, and Wl in a manual mode based on the opening/closing instruction signal, until the other operation instruction signal is received, the motors Mp, Mr, and Ml are continuously driven and the windows Wp, Wr, and Wl are continuously opened or closed, so that convenience for the user can be improved.

Even though the count value of the pulse by the position detection unit 1*a* is equal to or greater than a predetermined value corresponding to the fully open state or the fully closed state that is the end of the opening/closing operation of the windows Wp, Wr, and Wl, when the pulse is continuously detected by the pulse detection unit 4, the position abnormality determination unit 1*c* determines that there is an abnormality in the opening/closing position. Therefore, it is possible to reliably detect an abnormality in which the opening/closing positions of the windows Wp, Wr, and Wl detected by the position detection unit 1*a* deviate from the opening/closing positions of the windows Wp, Wr, and Wl due to noise included in the motor current.

Furthermore, the presence/absence of an interruption abnormality that is likely to occur as an abnormality in the opening/closing instruction signal can be reliably determined by the signal abnormality determination unit 1*f*. In addition, since the opening and closing of the windows Wp, Wr, and Wl is continued until the interruption abnormality state in the opening/closing instruction signal is confirmed, even if the frequency of the occurrence of the interruption abnormality in the opening/closing instruction signal is high, the user's convenience can be ensured.

The present invention can employ various embodiments other than the above-described embodiment. For example, in the above embodiment, the power window system 100 is shown as an example, in which based on the operation instruction signal transmitted from the power window device 10D for the main seat, the power window devices 10P, 10R, and 10L for sub seats drive the motors Mp, Mr, and Ml, and open and close the windows Wp, Wr, and Wl on the sub seats, but the present invention is not limited to this. In addition to this, for example, the present invention may also be applied to a power window system or an opening/closing body control system, in which based on an operation instruction signal transmitted from another opening/closing body control device or an electronic control device, a power window device or the other opening/closing body control device may drive a motor and open and close an opening/closing body such as a window. In addition, there may be a plurality of external devices that transmit an operation instruction signal, and there may be one or a plurality of opening/closing body control devices that transmit an operation instruction signal. Furthermore, the present invention can also be applied to an opening/closing body control system in which based on an operation instruction signal that is output according to a manipulation state by a manipulation switch installed on a seat, an opening/closing body control device drives a motor and opens and closes an opening/closing body.

In the above embodiment, although an example is shown, in which even though the count value of the pulse is equal to or greater than a predetermined value when the pulse is continuously detected and it is detected that the window is not in a fully open or fully closed state, it is determined that there is an abnormality in the opening/closing position of the window, but the present invention is not limited to this. In addition to this, for example, the amount of deviation of an opening/closing position of a window detected by the position detection unit la with respect to an actual opening/closing position of the window is estimated, and when the amount of deviation is equal to or greater than a predetermined amount, it may be determined that there is an abnormality in the opening/closing position.

The position abnormality determination unit 1*c* may determine that there is an abnormality in the opening/closing position when the position detection unit la cannot detect the opening/closing position normally due to submersion or failure of the position detection unit 1*a*, the pulse detection unit 4, the motor current detection unit 5, or the like for detecting the opening/closing position of the window, or when the opening/closing position information of the window stored in the storage units 2 and 2*x* is removed by a predetermined reset manipulation (such as attachment/detachment of a battery or a power window device), and the position detection unit la can no longer detect the window opening/closing position, or the like. Further, when the position abnormality determination unit 1*c* determines an abnormality of a plurality of types of opening/closing positions, an abnormality flag corresponding to each abnormality may be provided in the storage areas of the storage units 2 and 2*x*.

In the above embodiment, the interruption abnormality is exemplified as an abnormality in the opening/closing instruction signal. However, the present invention is not limited to this. In addition to this, for example, it may be determined that there is an abnormality in the opening/closing instruction signal, when the communication unit 6 cannot receive the opening/closing instruction signal normally because of the noise generated due to disturbance or failure (reception abnormality), or when there is a failure in the power window device 10D for the main seat that transmits the opening/closing instruction signal and an abnormality occurs in the signal level of the opening/closing instruction signal (transmission abnormality), or the like.

In the above embodiment, although an example is shown, in which a pulse synchronized with the rotation of the motor or a load on the motor is detected based on the motor current, but the present invention is not limited to this. In addition to this, for example, a pulse generator such as a rotary encoder may be installed in the vicinity of the motor, and the pulse generator may generate a pulse synchronized with the rotation of the motor. The rotation speed or load of the motor may be detected based on the pulse from the pulse generator, and the opening/closing position of the window may be detected based on the amount of change in the rotation speed or the load. The load of the motor may be detected on the basis of the rotation speed or frequency of the motor, for example.

In the above embodiment, an example is shown, in which the fully open and fully closed states of the window is detected based on the pulse count value synchronized with the rotation of the motor, the presence/absence of pulse detection, the rotation direction of the motor, and the load of the motor, but the present invention is not limited to this. In addition to this, for example, a sensor that detects the fully open and fully closed states of the window may be installed in a window frame or the like, and the fully open and fully closed states of the window may be detected based on an output signal from the sensor.

In the above embodiment, the window of the vehicle is taken as an example of an opening/closing body. However, the opening/closing body control device and the opening/closing body control system according to one or more embodiments of the invention can also be applied when controlling an opening/closing body such as a side portion door, a rear portion door, and a sunroof of a vehicle. Moreover, the opening/closing body control device and the opening/closing body control system according to one or more embodiments of the invention can also be applied when controlling a door or opening and closing of a door provided other than a vehicle.

While the invention has been described with respect to a limited number of embodiments, those skilled in the art, having the benefit of this disclosure, will appreciate that other embodiments can be devised which do not depart from the scope of the invention as disclosed herein. According, the scope of the invention should be limited only by the attached claims.

The invention claimed is:

1. An opening/closing body control device comprising:

a communication unit that receives an operation instruction signal instructing an operation of an opening/closing body;

a control unit that controls a drive of a motor that operates the opening/closing body based on the operation instruction signal received by the communication unit;

a pulse detection unit that detects a pulse synchronized with a rotation of the motor; and a position detection unit that detects an opening/closing position of the opening/closing body based on the pulse detected by the pulse detection unit, wherein the control unit opens and closes the opening/closing body by driving the motor based on the opening/closing position detected by the position detection unit, wherein the device further comprises:

an operation record unit that records content of the operation when the control unit controls the drive of the motor and operates the opening/closing body based on the operation instruction signal;

a position abnormality determination unit that determines a presence/absence of an abnormality in the opening/closing position detected by the position detecting unit; and a signal abnormality determination unit that determines a presence/absence of an abnormality in an opening/closing instruction signal during an as-needed opening/closing operation where the control unit drives the motor and opens and closes the opening/closing body while receiving the opening/closing instruction signal for instructing opening and closing of the opening/closing body as the operation instruction signal by the communication unit, wherein the signal abnormality determination unit measures a duration of an abnormality when it is determined that there is the abnormality in the opening/closing instruction signal, and further determines that an abnormal state of the opening/closing instruction signal is confirmed when the duration is equal to or longer than a predetermined confirmation time, wherein the control unit executes the as-needed opening/closing operation based on the opening/closing instruction signal received by the communication unit, even when the position abnormality determination unit determines that there is an abnormality in the opening/closing position, and continues driving the motor and continues opening and closing the opening/closing body based on the recorded content stored in the operation record until it is determined that the abnormal state in the opening/closing instruction signal is confirmed even when the signal abnormality determination unit determines that there is an abnormality in the opening/closing instruction signal during the as-needed opening/closing operation, and stops the motor and stops opening and closing the opening/closing body when the signal abnormality determination unit determines that the abnormal state in the opening/closing instruction signal is confirmed, and wherein the confirmation time when the position abnormality determination unit determines that there is an abnormality in the opening/closing position is shorter than the confirmation time when it is not determined that there is an abnormality in the opening/closing position.

2. The opening/closing body control device according to claim 1, further comprising:

a load detection unit that detects a load on the motor; and a pinch determination unit that determines a presence/absence of a pinch of a foreign object by the opening/closing body based on the load detected by the load detection unit, wherein the control unit temporarily stops the motor and then reversely drives the motor, and operates the opening/closing body in an opposite direction, when the signal abnormality determination unit determines that the abnormal state of the opening/closing instruction signal is confirmed and the pinch determination unit determines that the pinch is present during the as-needed opening/closing operation.

3. The opening/closing body control device according to claim 2, wherein the control unit temporarily stops the motor and then reversely drives the motor, and operates the opening/closing body in the opposite direction when the pinch determination unit determines that the pinch is present without determining that the abnormal state of the opening/closing instruction signal is confirmed by the signal abnormality determination unit during the as-needed opening/closing operation in a case where the position abnormality determination unit does not determine that there is an abnormality in the opening/closing position, and continues driving the motor and continues opening and closing the opening/closing body even when the pinch determination unit determines that the pinch is present without determining that the abnormal state of the opening/closing instruction signal is confirmed by the signal abnormality determination unit during the as-needed opening/closing operation in a case where the position abnormality determination unit determines that there is an abnormality in the opening/closing position.

4. The opening/closing body control device according to claim 1, wherein the position detection unit detects an opening/closing position of the opening/closing body based on a count value obtained by counting the number of pulses, and wherein even when the count value of the pulses counted by the position detection unit is equal to or greater than a predetermined value corresponding to a fully open state or a fully closed state that is an end of an opening/closing operation of the opening/closing body, the position abnormality determination unit determines that there is an abnormality in the opening/closing position when the pulse is continuously detected by the pulse detection unit.

5. The opening/closing body control device according to claim 1, wherein the signal abnormality determination unit determines that there is an abnormality in the opening/closing instruction signal when the abnormality occurs in which reception of the opening/closing instruction signal by the communication unit is interrupted.

6. An opening/closing body control system comprising:

the opening/closing body control device according to claim 1; and an electronic control device that transmits an operation instruction signal for instructing an operation of an opening/closing body to the opening/closing body control device.

7. The opening/closing body control system according to claim 6, wherein at least one opening/closing body control device is provided, wherein the electronic control device includes an opening/closing body control device different from the opening/closing body control device, wherein each opening/closing body control device controls a drive of a motor corresponding to each opening/closing body control device, and operates the corresponding opening/closing body, wherein the electronic control device transmits the operation instruction signal according to a manipulation state of a manipulation unit manipulated to instruct the operation of the opening/closing body corresponding to the at least one opening/closing body control device to the at least one opening/closing body control device, and wherein based on the operation instruction signal received from the electronic control device, the at least one opening/closing body control device controls the drive of the motor corresponding to the opening/closing body control device and operates the corresponding opening/closing body.

8. A power window device comprising the opening/closing body control device according to claim 1, wherein the power window device opens and closes a vehicle window, which is the opening/closing body.

9. A power window system comprising a plurality of power window devices for opening and closing a vehicle window, wherein among the plurality of power window devices, at least one power window device includes the opening/closing body control device according to claim 1, and another power window device transmits an operation instruction signal instructing an operation of the window to the at least one power window device according to a manipulation state of a manipulation switch manipulated to instruct opening and closing of the window corresponding to the at least one power window device, and wherein based on the operation instruction signal received from the another power window device, the at least one power window device controls the drive of the corresponding motor, and opens and closes the corresponding window.

* * * * *